US006655175B1

(12) United States Patent
Okamoto

(10) Patent No.: US 6,655,175 B1
(45) Date of Patent: Dec. 2, 2003

(54) METHOD FOR JOINING KNITTED FABRICS AND JOINED KNITTED FABRICS

(75) Inventor: Kazuyoshi Okamoto, Gose (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 0 days.

(21) Appl. No.: 10/297,197

(22) PCT Filed: Oct. 27, 2000

(86) PCT No.: PCT/JP00/07617

§ 371 (c)(1),
(2), (4) Date: Dec. 4, 2002

(87) PCT Pub. No.: WO00/94671

PCT Pub. Date: Dec. 13, 2001

(30) Foreign Application Priority Data

Jun. 5, 2000 (JP) ..... 2000-168225
Aug. 25, 2000 (JP) ..... 2000-256035

(51) Int. Cl.[7] ..... D04B 7/00
(52) U.S. Cl. ..... 66/69; 66/176
(58) Field of Search ..... 66/64, 60 R, 69, 66/171, 175, 176, 189, 70

(56) References Cited

U.S. PATENT DOCUMENTS 5,388,430 A * 2/1995 Essig ..... 66/64
5,916,272 A 6/1999 Nonnenmacher et al.
5,987,930 A * 11/1999 Nakai ..... 66/69
6,192,716 B1 * 2/2001 Essig et al. ..... 66/60 R
6,286,340 B1 * 9/2001 Yui ..... 66/70

FOREIGN PATENT DOCUMENTS

DE 19704646 A1 * 8/1998 ..... D04B/1/24
JP 2000-256947 9/2000
WO WO 00/12799 3/2000

* cited by examiner

*Primary Examiner*—Danny Worrell
(74) *Attorney, Agent, or Firm*—Arent Fox Kintner Plotkin & Kahn

(57) ABSTRACT

When a first knitted fabric, a second knitted fabric and a third knitted fabric are knitted, with the first knitted fabric sandwiched between the second and third knitted fabrics, and the first knitted fabric is joined to the second and third knitted fabrics by loops in final courses of the second and third knitted fabrics being sequentially overlapped with loops at ends of the first knitted fabric from a side thereof closer to the first knitted fabric, processing from one end thereof toward the other end thereof, the knitting wherein with the second knitted fabric and the third knitted fabric separately retained on front and back needle beds, the first knitted fabric and the third knitted fabric are shifted toward the second knitted fabric by racking; the first knitted fabric is changed over between the front and back needle beds and a loop of the first knitted fabric at an end thereof on the second knitted fabric side and a loop of the second knitted fabric at a side end thereof are overlapped with each other and a loop of the third knitted fabric at a side end thereof and a loop of the first knitted fabric at an end thereof on the third knitted fabric side are overlapped with each other; and then a yarn is fed to the first knitted fabric to form next course loops therein is repeatedly performed. This can provide a decreased number of times for the loop to be transferred between the front and back needle beds, as compared with the conventional method according to which the knitted fabrics can be allowed to be close to each other so as to be joined together solely by changing over the knitted fabrics between the front and back needle beds by transferring loops therebetween.

7 Claims, 25 Drawing Sheets

METHOD FOR JOINING KNITTED FABRICS AND JOINED KNITTED FABRICS

TECHNICAL FIELD

The present invention relates to a knitted fabric joining method for joining together knitted fabrics and, more particularly, to a knitted fabric joining method capable of eliminating the need of transference of loop between front and back needle beds for making the knitted fabrics close to each other or capable of reducing the number of times for the transference of loop therebetween therefor.

BACKGROUND ART

When knitted fabrics are knitted in different regions on a flat knitting machine and are joined together in the course of the knitting, the sewing process after the knitting can be simplified or eliminated. Many studies have been made for the use of this knitting technique or method. Take a sweater for instance, this knitting method can allow sleeves of the sweater and a body of the same to be joined together in a joining region extending from the underarms up to the shoulder, while they are knitted, so that the after knitting treatment can be simplified or eliminated. In the following, reference will be made of the knitting method for joining the sleeves 102, 103 of the sweater 101 to the body 104 of the same by using a four-bed flat knitting machine having upper needle beds disposed over a pair of front and back needle beds with reference to FIGS. 22–25. In FIGS. 23–25, FD denotes a front lower needle bed, FU denotes a front upper needle bed, BD denotes a rear lower bed, and BU denotes a back upper bed, and the numeric characteristics at the left side of the diagrams denote course numbers. In the course 0 in FIG. 23, the right sleeve 102, the body 104 and the left sleeve 103 are retained in order, as viewed from the left. A right front sleeve 102*a*and a right back sleeve 102*b*, a front body 104*a* and a back body 104*b*, and a left front sleeve 103*a* and a left back sleeve 103*b* are each joined together at both ends thereof and formed into a tubular body. In the course 1, the right back sleeve 102*b* is transferred to the front upper needle bed FU and the left front sleeve 103*a* is transferred to the back upper needle bed BU. In the course 2, after the back needle bed is racked leftwards one pitch, the right back sleeve 102*b* is transferred to the rear lower bed BD, so that a loop at the right end of the right back sleeve 102*b* is laid over a loop at the left end of the back body 104*b*, and the left front sleeve 103*a* is transferred to the front lower needle bed FD, so that a loop at the left end of the left back sleeve 103*a* is laid over a loop at the right end of the front body 104*a*. In the course 3, the right front sleeve 102*a* is transferred to the back upper needle bed BU and the left back sleeve 103*b* is transferred to the front upper needle bed FU. In the course 4, after the back needle bed is racked rightwards one pitch, the right front sleeve 102*a* is transferred to the front lower needle bed FD, so that a loop at the right end of the right front sleeve 102*a* is laid over a loop at the left end of the front body 104*a*, and the left back sleeve 103*b* is transferred to the back lower needle bed BD, so that a loop at the left end of the left back sleeve 103*b* is laid over a loop at the right end of the back body 104*b*. In the courses 5 and 6, a yarn feeder 110 is driven to knit the front body 104*a*, and in the courses 7 and 8, another yarn feeder 111 is driven to knit the back body 104*b*. In the knitting (1) illustrated in these courses 1 to 8, the right and left sleeves 102, 103 are joined to the body 104 without being knitted. Sequentially, in the courses 9 to 12, the same knitting as in the courses 1 to 4 is performed, so that the loop at the side end of the right sleeve 102 and the loop of the left sleeve 103 are laid over the loops of the front body 104*a* and the back body 104*b*, respectively. In the course 13, the front body 104*a* is knitted by using the yarn feeder 110 and the right front sleeve 102*a* is knitted by using the yarn feeder 113 used to knit the right sleeve 102. In the course 14, the front body 104*a* and the right front sleeve 102*a* are knitted, and the left front sleeve 103*a* is knitted by using the yarn feeder 114. In the course 15, the back body 104*b*, the right back sleeve 102*b* and the left front sleeve 103*a* are knitted. In the course 16, the back body 104*b*, the right back sleeve 102*b* and the left back sleeve 103*b* are knitted. In the course 17, the left back sleeve is knitted. Subsequently, the knitting in which whenever the knitting (1) is repeated an adequate number of times, the knitting (2) is performed is repeated, whereby the sleeves 102, 103 and the body 104 are joined together.

For joining together the sleeve 103 and the body 104 at an angle Z close to a right angle, the knitting (1) for joining together the sleeves 102, 103 and the body 104 without knitting the sleeves 102, 103 is only required. However, each time the knitting (1) for joining together the sleeves 102, 103 and the body 104 without knitting the sleeves 102, 103 is performed, the front knitted fabric parts 102*a*, 103*a* and the back knitted fabric parts 102*b*, 103*b* are changed over between the front and back needle beds by transferring loops the corresponding number of times to each back-and-forth movement therebetween, in order to shift the sleeves 102, 103 toward the body 104. Consequently, the loops must be transferred two times or more the number of wale of the sleeves 102, 103, for joining all the loops to the body 104. Accordingly, for example, when there is a large number of wale of the sleeves 102, 103, or when a weak yarn is used for knitting, or when further finer loops are formed in the knitting, there is the possibility that when the same loop is repeatedly transferred between the front and back needle beds, yarn breakage may occur or the loop may be stretched out or elongated. To avoid this problem, in the joining method mentioned above, whenever the knitting (1) is repeated an adequate number of times, the knitting (2) is performed, whereby the knitting for joining is performed while the loop to be transferred is transferred to a loop newly formed. However, the knitting (2) produces sleeve caps 105*a*, 105*b*, resulting in reduction in the sleeve joining angle Z. Thus, in the knitting method mentioned above, even after the joining of the sleeves 102, 103 and the body 104 is started, the sleeves 102, 103 must be knitted in order to avoid the yarn breakage and the elongation of the loop. Due to this, it is hard to join together the sleeves 102, 103 and the body 104 at a sleeve joining angle Z as large as right angles at which an orientation of the wale of the sleeves and an orientation of the wale of the body are crossed each other. Especially when a weak yarn is used for the knitting, the knitting (2) for knitting the sleeves 102, 103 must be performed an increased number of times and, as a result of this, a sufficient sleeve joining angle Z is not afforded.

On the other hand, Japanese Laid-open (Unexamined) Patent Publication No. 2000-256947 discloses the method for joining the sleeves with sleeve caps formed by a flechage knitting to the body, before the start of the joining of the sleeves and the body. In the method disclosed by Japanese Laid-open (Unexamined) Patent Publication No. 2000-256947, right and left sleeves and the body are knitted in different regions on needle beds, respectively, with the body sandwiched between the right and left sleeves. Then, the sleeves are knitted from cuffs up to and the body is knitted from a rib up to their underarms at which the joining of the sleeves and the body is started. Then, the knitting of the body is halted temporarily and the sleeve caps are knitted in the flechage knitting and formed into any desired shape. The final courses of the sleeve caps are knitted by using a special yarn such as an elastic yarn. Sequentially, with the loops in the final courses of the sleeve to be overlapped with the body kept retained, the knitting of the body is restarted. Then, the knitting wherein the loops at the side ends of the body and the loops of the sleeves are overlapped with each other and the yarn is fed to the body to join together the sleeves and the body is repeated. The knitting method mentioned above has the advantage that since the sleeve caps are formed before the joining of the sleeves and the body is started, the shape of the sleeve caps can be freely set, without any need to consider a ratio between the number of knitting courses of the sleeves and that of the body, differently from the knitting wherein the sleeves and the body are joined together while the sleeves and the body are knitted in parallel with each other. In addition, it also has the advantage that since the special yarn is used for knitting the final courses of the sleeve caps, even when the loops in the joining region are transferred between the front and back needle beds again and again to shift the sleeves toward the body, occurrence of yarn breakage and yarn elongation in the joining region are suppressed. However, the use of the special yarn produces increase in manufacturing costs and needs a special device for feeding the elastic yarn with an adequate tension.

The present invention discloses a knitted fabric joining method capable of eliminating the need to transfer a loop between front and back needle beds for making the knitted fabrics close to each other or reducing the number of times for the loop to be transferred therebetween.

DISCLOSURE OF THE INVENTION

To accomplish the objects mentioned above, the present invention provides a knitted fabric joining method, using a flat knitting machine comprising at least a pair of first and second needle beds, which are extended laterally and confront each other in front and back; each of which has a large number of needles; and at least either of which can be racked laterally to transfer loops between the front and back needle beds, for knitting a first knitted fabric, a second knitted fabric and a third knitted fabric, with the first knitted fabric sandwiched between the second and third knitted fabrics, and joining the first knitted fabric to the second and third knitted fabrics in a joining process in which the knitting wherein loops in final courses of the second and third knitted fabrics are sequentially overlapped with loops at ends of the first knitted fabric from a side thereof closer to the first knitted fabric, processing from one end thereof toward the other end thereof, and next course loops are formed in the first knitted fabric is repeatedly performed, wherein with the second knitted fabric and the third knitted fabric. separately retained on front and back needle beds, the first knitted fabric and the third knitted fabric are shifted toward the second knitted fabric by racking; then the first knitted fabric is changed over between the front and back needle beds and a loop of the first knitted fabric at an end thereof on the second knitted fabric side and a loop of the second knitted fabric at a side end thereof are overlapped with each other and a loop of the third knitted fabric at a side end thereof and a loop of the first knitted fabric at an end thereof on the third knitted fabric side are overlapped with each other; and then a yarn is fed to the first knitted fabric to form next course loops therein, this knitting process being repeatedly performed. With this construction of the present invention, in the process of joining the first knitted fabric to the second and third knitted fabrics, the third knitted fabric is shifted toward the second knitted fabric by racking of the front and back needle beds and also the first knitted fabric is changed over between the front and back needle beds, whereby the first and third knitted fabrics are both shifted toward the second knitted fabric. In addition, each time loops of the second and third knitted fabrics at side ends thereof and loops of the first knitted fabric at side ends thereof are overlapped with each other, the first knitted fabric is knitted to join together the first, second and third knitted fabrics. This knitting for joining together the knitted fabrics can provide a decreased number of times for the loop to be transferred between the front and back needle beds, as compared with the conventional method according to which the knitted fabrics can be allowed to be close to each other so as to be joined together solely by changing over the knitted fabrics between the front and back needle beds by transferring loops therebetween.

In the knitted fabric joining method, the first knitted fabric, the second knitted fabric, and the third knitted fabric each comprise a first knitted fabric part knitted in association with the first needle bed and a second knitted fabric part knitted in association with the second needle bed, the first knitted fabric part and the second knitted fabric part being knitted in an overlapping relation in front and back and formed into a tubular form, and wherein the knitting for shifting the first knitted fabric parts of the first and third knitted fabrics toward the first knitted fabric part of the second knitted fabric and the knitting for shifting the second knitted fabric parts of the first and third knitted fabrics toward the second knitted fabric part of the second knitted fabric are performed in parallel.

In the knitted fabric joining method, the joining process comprises the steps:

a) that the second knitted fabric part of the second knitted fabric is retained on the first needle bed and the first knitted fabric part of the third knitted fabric is retained on the second needle bed;

b) that with the second knitted fabric part of the second knitted fabric retained on the first needle bed and the first knitted fabric part of the third knitted fabric retained on the second needle bed, the first knitted fabric part of the third knitted fabric is shifted toward the first knitted fabric part of the first knitted fabric by racking, so that a loop of the first knitted fabric part of the third knitted fabric at a side end thereof and a loop of the first knitted fabric part of the first knitted fabric at a side end thereof are opposed to each other and are overlapped with each other, and the second knitted fabric part of the first knitted fabric is shifted toward the second knitted fabric part of the second knitted fabric, so that a loop of the second knitted fabric part of he first knitted fabric at an end thereof on the second knitted fabric side and a loop of the second knitted fabric part of the second knitted fabric at a side end thereof are opposed to each other and are overlapped with each other;

c) that in the course of the first knitted fabric part of the first knitted fabric being changed over between the front and back needle beds, the first knitted fabric part of the first knitted fabric is shifted toward the first knitted fabric part of the second knitted fabric, so that a loop of the first knitted fabric part of the first knitted fabric at an end thereof on the second knitted fabric side and a loop of the first knitted fabric part of the second knitted fabric at a side end thereof are opposed to each other and are overlapped with each other;

d) that in the course of the second knitted fabric part of the first knitted fabric being changed over between the front and back needle beds, the second knitted fabric part of the third knitted fabric is shifted toward the second knitted fabric part of the first knitted fabric, so that a loop of the first knitted fabric part of the third knitted fabric at a side end thereof and a loop of the second knitted fabric part of the first knitted fabric at an end thereof on the third knitted fabric side are opposed to each other and are overlapped with each other;

e) that yarns are fed to the first knitted fabric part and the second knitted fabric part of the first knitted fabric to form next course loops therein; and f) that the steps b to e are repeated. With this construction of the present invention, by racking the front and back needle beds in one direction, the first knitted fabric part of the third knitted fabric is shifted toward the first knitted fabric part of the first knitted fabric, so that a loop of the first knitted fabric part of the third knitted fabric at a side end thereof and a loop of the first knitted fabric part of the first knitted fabric at an end thereof on the third knitted fabric side are opposed to each other and are overlapped with each other, and a loop of the second knitted fabric part of the first knitted fabric at an end thereof on the second knitted fabric side and a loop of the second knitted fabric part of the second knitted fabric at a side end thereof are opposed to each other and are overlapped with each other. Sequentially, with the loops of the second knitted fabric part of the first knitted fabric transferred to the first needle bed, the needle beds are racked so that a loop of the first knitted fabric part of the first knitted fabric at an end thereof on the second knitted fabric side and a loop of the first knitted fabric part of the second knitted fabric at a side end thereof are opposed to each other and overlapped with each other and then the second knitted part of the first knitted fabric is transferred back to the second needle bed and then a yarn is fed to the second knitted fabric part of the first knitted fabric to form next course loops therein. Likewise, with the loops of the second knitted fabric part of the first knitted fabric transferred to the second needle bed, the needle beds are racked so that a loop of the second knitted fabric part of the first knitted fabric at a side end thereof and a loop of the second knitted fabric part of the third knitted fabric at a side end thereof are opposed to each other and overlapped with each other and then the first knitted part of the first knitted fabric is transferred back to the first needle bed and then a yarn is fed to the first knitted fabric part of the first knitted fabric to form next course loops therein. The repetition of this knitting provides the result that while the first knitted fabric and the third knitted fabric are shifted toward the second knitted fabric, the first knitted fabric part and the second knitted fabric part are joined together. This can provide a decreased number of times for the second and third knitted fabrics to be transferred between the front and back needle beds, as compared with the conventional method according to which the knitted fabrics can be allowed to be close to each other so as to be joined together solely by changing over the knitted fabrics between the front and back needle beds by transferring loops therebetween.

In the knitted fabric joining method of the present invention, a forked portion is formed in the first knitted fabric part of the first knitted fabric, and after the forked portion is started in form, the first knitted fabric part of the first knitted fabric is knitted in the form of a first "a" knitted fabric and a first "b" knitted fabric which confront each other across the forked portion, the joining method comprising the steps:

a) that the knitting wherein each time one of the needle beds is racked relative to the other, with the first knitted fabric part of the third knitted fabric retained on the second needle bed, so that a loop of the first knitted fabric part of the third knitted fabric at a side end thereof and a loop of the first "b" knitted fabric at a side end thereof are opposed to each other and are overlapped with each other, the yarn is fed to the first "b" knitted fabric to form the next course loops therein and the knitting wherein a loop of the second knitted fabric part of the second knitted fabric is made to circle into the first needle bed are repeated;

b) that the knitting wherein each time the second needle bed is racked, with the first knitted fabric part of the second knitted fabric and the loop of the second knitted fabric part as was transferred to the first needle bed retained on the second needle bed, so that a loop of the first knitted fabric part of the second knitted fabric at a side end thereof and a loop of the first "a" knitted fabric at a side end thereof are opposed to each other and are overlapped with each other, the yarn is fed to the first "a" knitted fabric to form the next course loops therein and the knitting wherein a loop of the third knitted fabric is made to circle into the first needle bed are repeated;

c) that in the course of the second knitted fabric part of the first knitted fabric being changed over between the front and back needle beds, a loop of the second knitted fabric part of the first knitted fabric at a side end thereof and a loop of the second knitted fabric part of the third knitted fabric at a side end thereof are opposed to each other and are overlapped with each other; and each time a loop of the second knitted fabric part of the second knitted fabric at a side end thereof and a loop of the second knitted fabric part of the first knitted fabric at an end thereof on the second knitted fabric side are opposed to each other and are overlapped with each other, the yarn is fed to the second knitted fabric part of the first knitted fabric to form next course loops therein and also a loop of the second knitted fabric part of the second knitted fabric on the first needle bed is made to circle into the second needle bed; and d) that in the course of the second knitted fabric part of the first knitted fabric being changed over between the front and back needle beds, a loop of the second knitted fabric part of the first knitted fabric at an end thereof on the second knitted fabric side and a loop of the second knitted fabric part of the second knitted fabric at a side end thereof are opposed to each other and are overlapped with each other; and each time a loop of the second knitted fabric part of the third knitted fabric at a side end thereof and a loop of the second knitted fabric part of the first knitted fabric at a side end thereof are opposed to each other and are overlapped with each other, the yarn is fed to the second knitted fabric part of the first knitted fabric to form next course loops therein. With this construction of the present invention, after the forked portion is started in form, the knitting wherein while the first "b" knitted fabric of the first knitted fabric is knitted, a loop of the first "b" knitted fabric at a side end thereof and a loop of the third knitted fabric at a side end thereof are overlapped with each other and the circle knitting wherein a loop of the second knitted fabric part of the second knitted fabric is made to circle into the first needle bed to minimize the difference between the number of loops retained on the first needle bed and the number of loops retained on the second needle bed are repeated until the joining of all loops of the first knitted fabric part of the third knitted fabric and the first "b" knitted fabric is completed. Sequentially, the knitting wherein while the first "a" knitted fabric of the first knitted fabric is knitted, a loop of the first "a" knitted fabric at a side end thereof and a loop of the second knitted fabric at a side end thereof are overlapped with each other and the circle knitting wherein a loop of the third knitted fabric at a side end thereof is made to circle into the first needle bed are repeated until the joining of all loops of the first knitted fabric part of the second knitted fabric and the loops of the first "a" knitted fabric is completed. As a result of the knitting mentioned above, the first knitted fabric parts of the first knitted fabric and second and third knitted fabrics are joined together and the second knitted fabric part of the second knitted fabric and the second knitted fabric part of the third knitted fabric are separately retained on the first needle bed and the second needle bed. Sequentially, the knitting for joining together the second knitted fabric parts is performed. The knitting for shifting the second knitted fabric part of the first knitted fabric toward the third knitted fabric and the knitting for shifting the third knitted fabric toward the third knitted fabric are performed, whereby loops of the first knitted fabric at side ends thereof and loops of the second and third knitted fabrics at side ends thereof are overlapped with each other. This knitting process is repeated until the loops of the second knitted fabric part of the second knitted fabric are retained on the second needle bed and the loops of the second knitted fabric part of the third knitted fabric are retained on the first needle bed. Sequentially, the knitting wherein while the second knitted fabric part of the first knitted fabric is shifted toward the second knitted fabric, a loop of the first knitted fabric at a side end thereof and a loop of the second knitted fabric at a side end thereof are overlapped with each other and a loop of the third knitted fabric at a side end thereof and a loop of the first knitted fabric at a side end thereof are overlapped with each other is repeated until the joining of all loops of the second and third knitted fabrics and the loops of the first knitted fabric is completed. After this manner, the knitted fabrics are joined together. It is to be noted that the joining of the first "a" knitted fabric and the third knitted fabric and the joining of the first "a" knitted fabric and the second knitted fabric may be performed in random order. Also, after the second knitted fabric parts are started in joining, the second knitted fabric and the third knitted fabric may be changed in order.

In the knitted fabric joining method of the present invention, the first knitted fabric is a knitted fabric knitted in the form of a body and the second and third knitted fabrics are knitted fabrics knitted in the form of right and left sleeves, and after sleeve caps of the right and left sleeves are formed in a flechage knitting, the sleeves and the body may be joined together.

In the knitted fabric joining method of the present invention, the first knitted fabric, the second knitted fabric, and the third knitted fabric may be knitted in the form of a first region, a second region, and a third region of an entire knitted fabric formed in the form of a single tubular fabric.

Also, the present invention provides a knitted fabric knitted by using a flat knitting machine comprising at least a pair of first and second needle beds, which are extended laterally and confront each other in front and back; each of which has a large number of needles; and at least either of which can be racked laterally to transfer loops between the front and back needle beds, wherein a first knitted fabric, a second knitted fabric and a third knitted fabric are knitted, with the first knitted fabric sandwiched between the second and third knitted fabrics, and the first knitted fabric is joined to the second and third knitted fabrics in a joining process in which the knitting wherein loops in final courses of the second and third knitted fabrics are sequentially overlapped with loops at ends of the first knitted fabric from a side thereof closer to the first knitted fabric, processing from one end thereof toward the other end thereof, and next course loops are formed in the first knitted fabric is repeatedly performed, in the process of which with the second knitted fabric and the third knitted fabric separately retained on front and back needle beds, the first knitted fabric and the third knitted fabric are shifted toward the second knitted fabric by racking; the first knitted fabric is changed over between the front and back needle beds and a loop of the first knitted fabric at an end thereof on the second knitted fabric side and a loop of the second knitted fabric at a side end thereof are overlapped with each other and a loop of the third knitted fabric at a side end thereof and a loop of the first knitted fabric at an end thereof on the third knitted fabric side are overlapped with each other; and then a yarn is fed to the first knitted fabric to form next course loops therein, this knitting process being repeatedly performed to join together the first, second and third knitted fabrics.

BEST MODE FOR CARRYING OUT THE INVENTION

Figure 1:
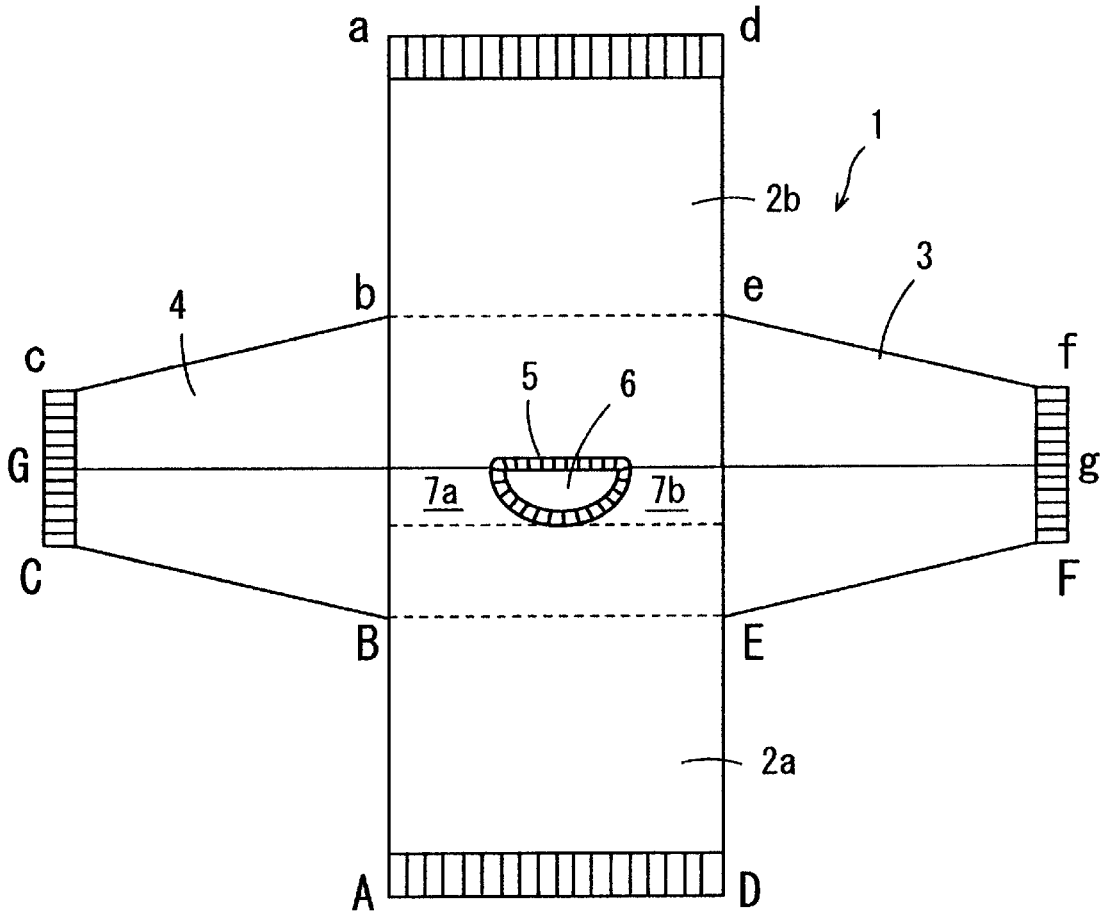
FIG. 1 shows a knitted fabric of a sweater knitted in a first embodiment.
Figure 2:
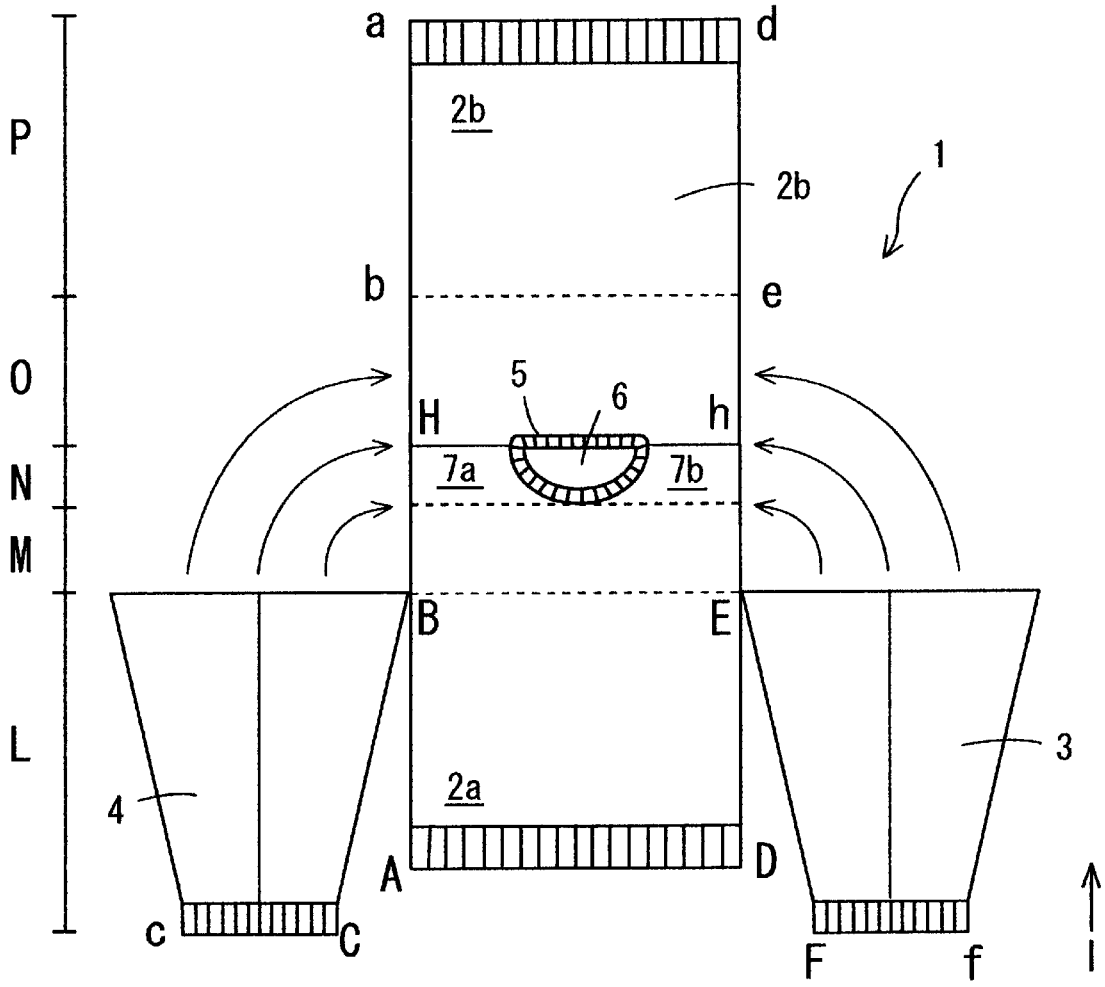
FIG. 2 illustrates the knitting steps for knitting the knitted fabric of the sweater in the first embodiment.

Certain preferred embodiments of the present invention will be described in detail with reference to the accompanying drawings. In the first embodiment mentioned below, a two-bed flat knitting machine is used wherein a front needle bed FD and a back needle bed BD, each having a large number of needles arranged in parallel thereon, are disposed in front and back to confront each other, and the back needle bed BD is so structured as to be racked laterally relative to the front needle bed FD so that the stitch transfer can be made between the front needle bed FD and the back needle bed BD. In the second to fourth embodiments, a four-bed flat knitting machine is used wherein a front lower needle bed FD and a back lower needle bed BD are arranged in front and back to confront each other and an front upper needle bed FU and an back upper needle bed BU, each having a large number of needles arranged in parallel at the same pitches as in the lower needle beds, are disposed over the front lower needle bed FD and the back lower needle bed BD, respectively, and which is structured so that the back needle beds BD are so structured as to be racked laterally relative to the front needle beds FD so that the stitch transfer can be made between the front lower needle bed and the back lower needle bed and between the upper needle bed and the lower needle bed confronting each other. It is to be noted that the first embodiment may use the four-bed flat knitting machine for knitting knitted fabrics, while on the other hand, the second to fourth embodiments may use the two-bed knitting machine for knitting knitted fabrics. When the two-bed flat knitting machine is used for knitting knitted fabrics, a half-gauge knitting is performed. In the half-gauge knitting, needles used for knitting front stitches of a front knitted fabric and needles used for knitting back stitches of a back knitted fabric are alternately arranged on the front needle bed FD, and needles used for knitting front stitches of the back knitted fabric and needles used for knitting back stitches of the front knitted fabric are arranged on the back needle bed BD, so that the respective knitted fabrics are knitted with the alternate needles. In the half-gauge knitting, when the front knitted fabric is knitted, the back stitches of the back knitted fabric formed on the front needle bed FD are transferred to the needles of the back needle bed BD and are all retained on (associated with) the back needle bed BD, while on the other hand, when the back knitted fabric is knitted, the back stitches of the front knitted fabric formed on the back needle bed BD are transferred to the needles of the front needle bed FD and are all retained on (associated with) the front needle bed FD, whereby the respective knitted fabrics are knitted in such a relation as to overlap with each other in front and back. Reference is made to Japanese Patent Publication No. Hei 3(1991)-75656 for details of the half-gauge knitting and further description thereon is omitted here. The half-gauge knitting enables the empty needles used for transference of stitch to be always reserved for the knitted fabrics on the opposed needle beds. The use of the empty needles enables the knitting of the structure pattern, such as links, garter and rib, in which front stitches and back stitches are mixed and also enables the loops of the sleeves and body to be shifted laterally so as to be joined to each other.

First Embodiment

The first embodiment will be described with reference to FIGS. 1–5. The first embodiment is an embodiment of a method for knitting a T-sleeve sweater. A knitted fabric 1 of the sweater is knitted in the direction indicated by an arrow I. The knitted fabric 1 includes a front body 2*a*, a back body 2*b*, a left sleeve 3 and a right sleeve 4, and the front body 2*a* has a neckline opening 6 around which a collar is formed. In the following, the "right" and "left" of the sweater are intended to mean the right hand part and the left-hand part when viewing from a wearer who wears the sweater 1. The knitted fabric 1 of the sweater is knitted in the steps L-P of FIG. 2. In the step L, the body 2*a* and the left and right sleeves 3, 4 are knitted in parallel with each other in different regions before they are joined together. In the step M, a right front body 7*a* of the front body 2*a* and a left front body 7*b* of the same are knitted via their respective yarn feeders, and the sleeves 3, 4 and the front body 2*a* are joined together while forming the neckline opening 6. After the front body 2*a* is knitted up to the line H-h, a collar 5 is formed in the front body 2*a* and the final course of the collar is bound off in a known cast-off knitting to prevent stitch loosening. In the next step O, after setting up the collar 5, the collar 5 is knitted up before the knitting of the back body 2*b*. Sequentially, while the bock body 2*b* is knitted, the left and right sleeves 3, 4 are shifted toward the body, so that the sleeves 3, 4 and the body 2 are joined together. After completion of the joining of the sleeves 3, 4 and the body 2, the back body 2*b* is knitted in the step P, and the final course of the back body 2*b* is bound off in the cast-off knitting, to bring the knitted fabric 1 of the sweater to completion. After completion of the knitting, the lines A-B-C and a-b-c and the lines D-E-F and d-e-f are sewed together to bring the sweater into completion.

Figure 3:
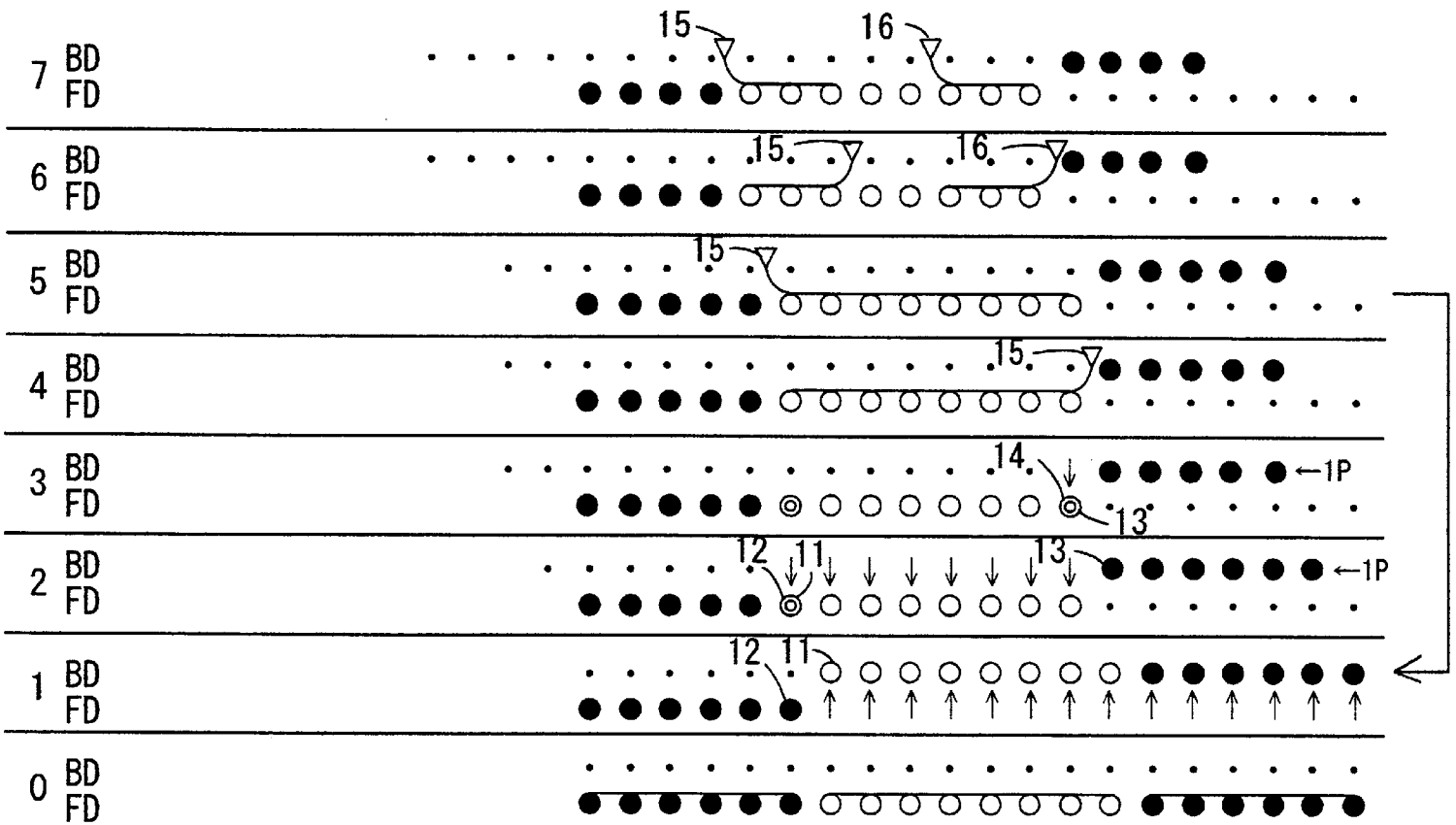
FIG. 3 illustrates knitting courses of the first embodiment.
Figure 4:
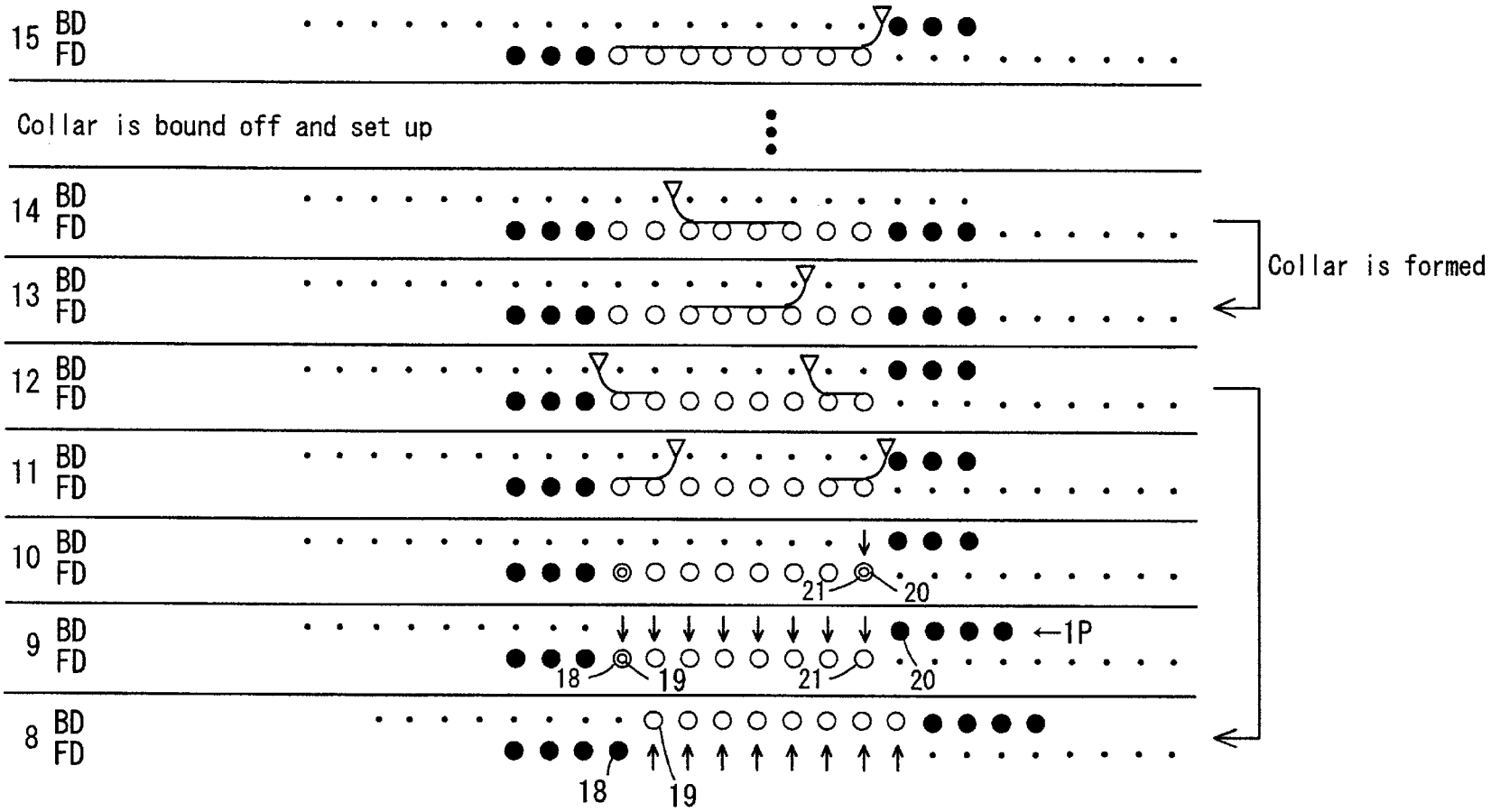
FIG. 4 illustrates knitting courses of the first embodiment.
Figure 5:
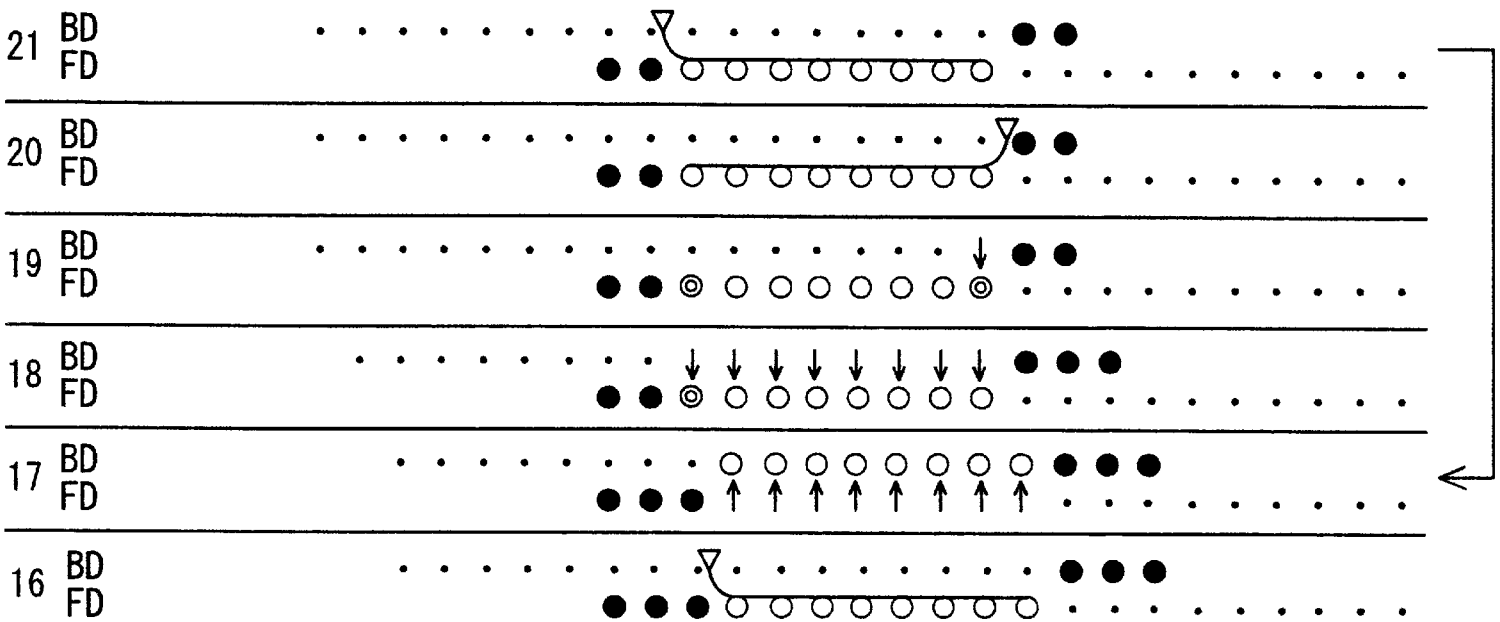
FIG. 5 illustrates knitting courses of the first embodiment.
Figure 6:
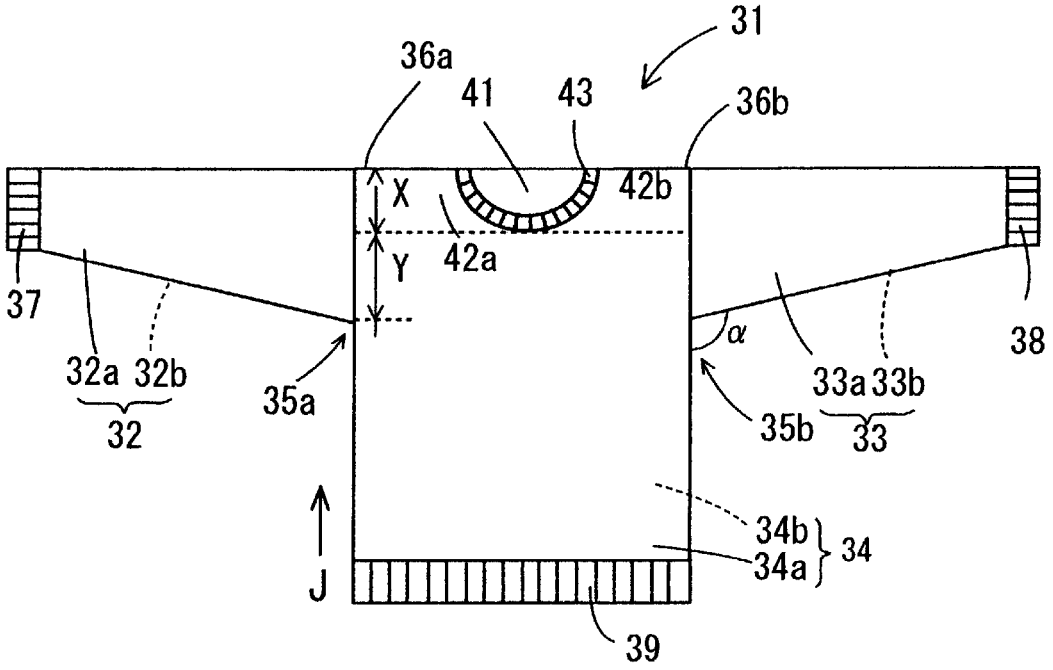
FIG. 6 shows a knitted fabric of a sweater knitted in a second embodiment.

The knitted fabric joining method of this embodiment is characterized in the knitting in the steps M-O for joining together the sleeves 3, 4 and the body 2. In the following, the knitting in the steps M-O is described in detail. The course 0 of FIG. 3 shows the state after the knitting in the step L is completed. In the course 0, the left and right sleeves 3, 4 depicted by black circles are retained at the right and left sides of the front body 2*a* depicted by white circles. The knitting in the step M before the start of forming of the neckline opening 6 at which the knitted fabric is forked is described. In the course 1, the loops of the front body 2*a* and left sleeve 3 are transferred to the back needle bed BD. In the course 2, after the back needle bed BD is racked leftwards one pitch, the front body 2*a* is transferred to the front needle bed FD, so that the loop 11 at the left end of the front body 2*a* and the loop 12 at the left end of the right sleeve 4 are overlapped with each other. In the course 3, after the back needle bed BD is further racked leftwards one pitch, the loop 13 of the left sleeve 3 at a side end thereof on the body 2 side is transferred to the front needle bed FD, so that the loop 13 is overlapped with the loop 14 at the right end of the front body 2*a*. In the courses 4 and 5, the yarn feeder 15 is used to knit the front body 2*a*. Subsequently, the knitting in the courses 1–5 are repeated in the step M to join together the sleeves 3, 4 and the front body 2*a*. While in this embodiment, the loops are overlapped in the order of the loop of the right sleeve 4 and the loop of the front body 2*a*, and then the loop of the front body 2*a* and the loop of the left sleeve 3, the loops may be overlapped in the same order at both right and left sides by transferring the front body 2*a* to the front needle bed FD, with the loops of the right sleeve 4 transferred to the back needle bed BD, and overlapping the loop of the right sleeve 4 with the loop of the front body 2*a* retained on the front needle bed FD.

In the course N in which the neckline opening 6 is formed, an additional yarn feeder 17 is added for the courses 6–7. The yarn feeder 15 is used to knit the right front body 7*a* and the yarn feeder 16 is used to knit the left front body 7*b*. In this course, the needles are put into the resting state from the center of the front body 2*a* toward the outside of the same, to form the neckline opening 6. In the course 8, the front body 2*a* and the left sleeve 3 are transferred to the back needle bed BD. In the course 9, after the back needle bed BD is racked leftwards on pitch, the front body 2*a* is transferred to the front needle bed FD, so that the loop 19 at the side end of the front body 2*a* is overlapped with the loop 18 at the right end of the right sleeve 4. In the course 10, after the back needle bed BD is further racked leftwards one pitch, the loop 20 at the right end of the left sleeve 3 is transferred to the front needle bed FD, so as to be overlapped with the loop 21 at the right side end of the front body 2*a*. In the courses 11 and 12, when the right front body 7*a* and the left front body 7*b* are knitted, the needles positioned at the outside as viewed in the courses 6–7 are put into the rest state, to widen the neckline opening 6. Subsequently, the knitting of the courses 8–12 are repeated while the needles to be used are changed, whereby the front body 2*a* is knitted up to the line H-h, while the neckline opening 6 is formed. In the next courses 13–14, the yarn is continuously fed to the needles that are in the rest state, to form the collar 5. Then, the collar 5 is bound off at the final course in the cast-off knitting, not shown, and is set up in the known set-up knitting, not shown, so that the collar 5 is formed in the front body and the back body. In the next step O, after the front body 2*a* is knitted in the courses 15, 16, the same knitting as the knitting of the courses 1–5 is repeated in the courses 17–21 to join together the back body 2*b* and the left and right sleeves 3, 4. Then, in the step P after the completion of the joining of the sleeves 3, 4 and the back body 2*b*, the remaining part of the back body 2*b* is knitted. Although the illustrated embodiment shows an example that all loops can be joined together within a maximum racking pitch of the back needle bed BD, if the racking pitches required for all the loops to be joined together exceed the maximum racking pitches of the back needle bed BD, then a racking-back knitting may be performed in which the loops retained on the back needle bed BD are transferred to the front needle bed for a while and after the back needle bed BD is racked rightwards, with all the loops retained on the front needle bed FD, the loops as were transferred to the front needle bed FD are transferred back to the back needle bed BD.

As mentioned above, in the knitted fabric joining method of the this embodiment, a phase lag resulting from the racking of the front and back needle beds is used, whereby whenever the body 2 and the left and right sleeves 3, 4 are joined together, the body 2 is shifted one pitch toward the right sleeve 4 and the left sleeve 3 is shifted two pitches toward the body, to overlap their respective loops with each other. Consequently, after the start of the knitting for joining, the sleeves 3, 4 in which no next course loop is formed need not be transferred between the front and back needle beds, in order to be shifted toward the body 2, except the case where the racking-back knitting is performed. Although the body 2 is transferred between the front and back needle beds, since the next course loop is formed in the body 2 even after the start of the joining process, no problem resulting from the transference between the front and back needle beds is presented. Thus, when at least a part of the joining of the sleeves 3, 4 and the body 2 is processed by the method of this embodiment, the sleeves 3, 4, in which no next course loop is formed to allow the loops of the body 2 and the loops of the sleeves 3, 4 to be overlapped with each other in the state in which the body 2 and the sleeves 3, 4 are close to each other, need not be transferred between the front and back needle beds so as to be shifted toward the body 2. As a result of this, yarn breakage or loop elongation is hardly generated. Thus, after the start of joining of the sleeves 3, 4 and the body 2, the sleeves 3, 4 can be joined to the body without knitting the sleeves 3, 4. This enables the sleeves 3, 4 and the body 2 to be joined together at an angle as large as right angles at which an orientation of the wale of the sleeves and an orientation of the wale of the body are crossed each other, and as such can allow the sleeve joining angle to be freely set.

Second Embodiment

Next, the second embodiment will be described with reference to FIGS. 6–16. The second embodiment is an example of an application of the knitting of the first embodiment to the joining of tubular fabrics and is an embodiment of the method for knitting the T-sleeve sweater. In the sweater 31, left and right tubular sleeves 32, 33 and a tubular body 34 are joined together from underarms 35*a*, 35*b* to shoulders 36*a*, 36*b*. The left and right sleeves 32, 33 are knitted from cuffs 37, 38 and the body 34 is knitted from a hem 39 in the direction indicated by an arrow J. After the start of the joining of the sleeves 32, 33 and the body 34, a front body 34*a* and a back body 34*b* are knitted with different yarn feeders running in reciprocation. Whenever a proper number of courses of the body 34 are knitted, the loops of the final courses of the sleeves 32, 33 are overlapped with the loops at the side ends of the body 34 and the yarn is fed to the front body 34*a* and the back body 34*b* to join together the sleeves 32, 33 and the body 34. The neckline opening 41 is formed in the front body 34*a* in the process of joining the front body 34*a* to the sleeves 32, 33, and after the start of the forming of the neckline opening 41, a right front body 42*a* and a left front body 42*b* of the front body 34*a* are knitted by use of different yarn feeders. After completion of the joining of the sleeves 32, 33 and the body 34, the front body 34*a* and the back body 34*b* are joined together at the shoulders 36*a*, 36*b* and then bound off in the known cast-off knitting and, finally, the collar 43 is formed around the neckline. After this manner, the sweater 31 is completed.

Figure 7:
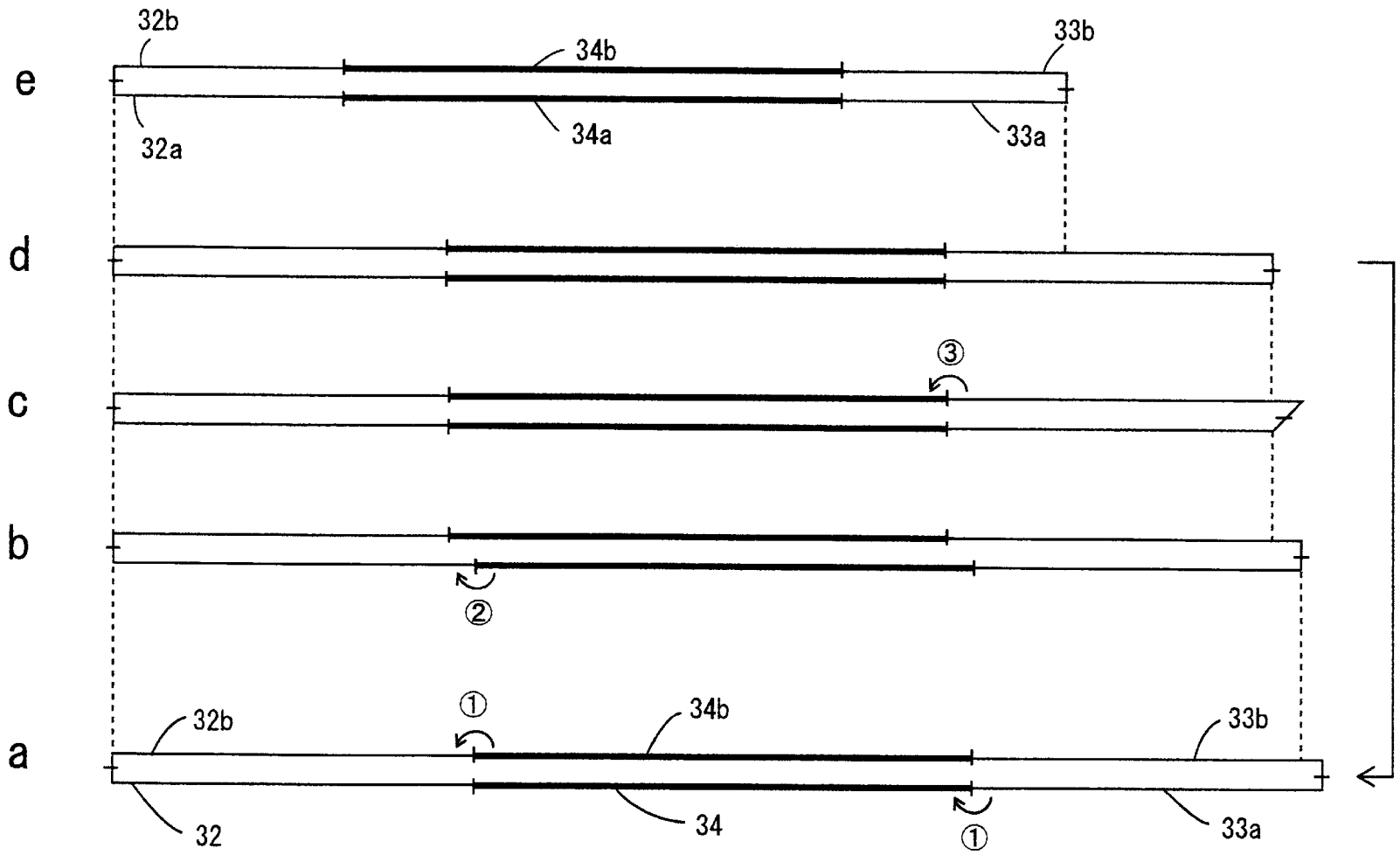
FIG. 7 illustrates the knitting in the step Y of the second embodiment.
Figure 8:
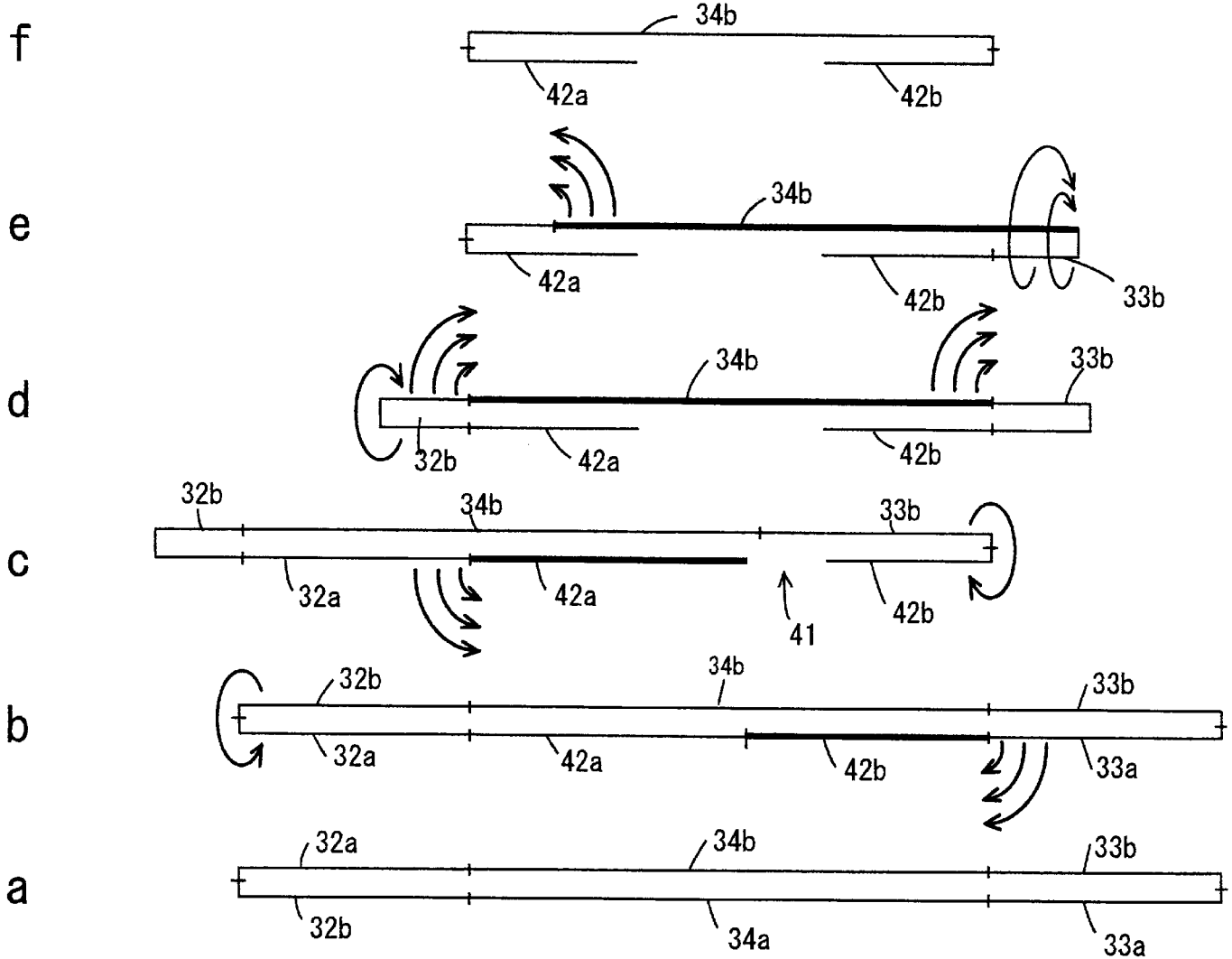
FIG. 8 illustrates the knitting in the step X of the second embodiment.
Figure 9:
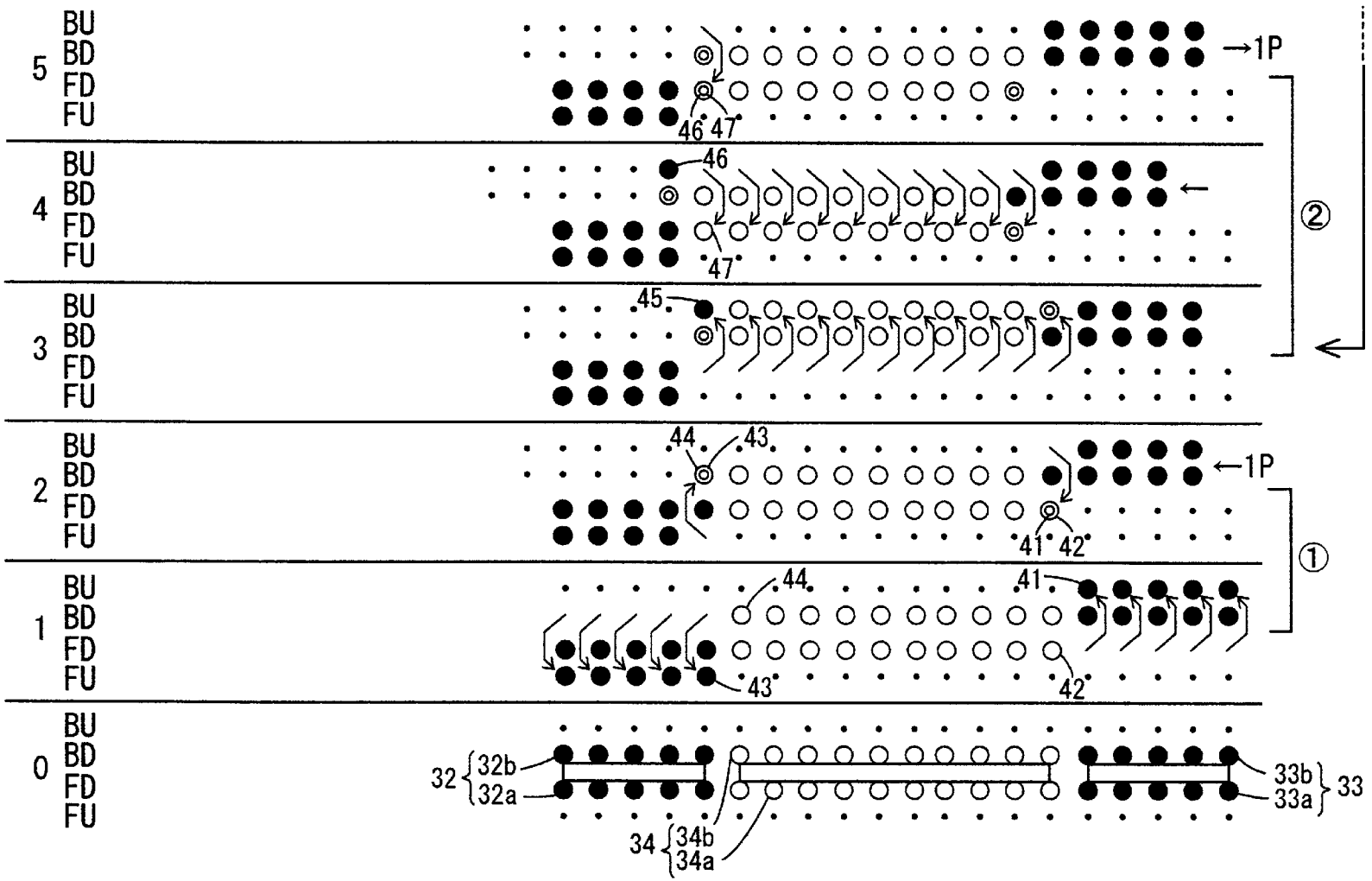
FIG. 9 illustrates knitting courses of the second embodiment.
Figure 10:
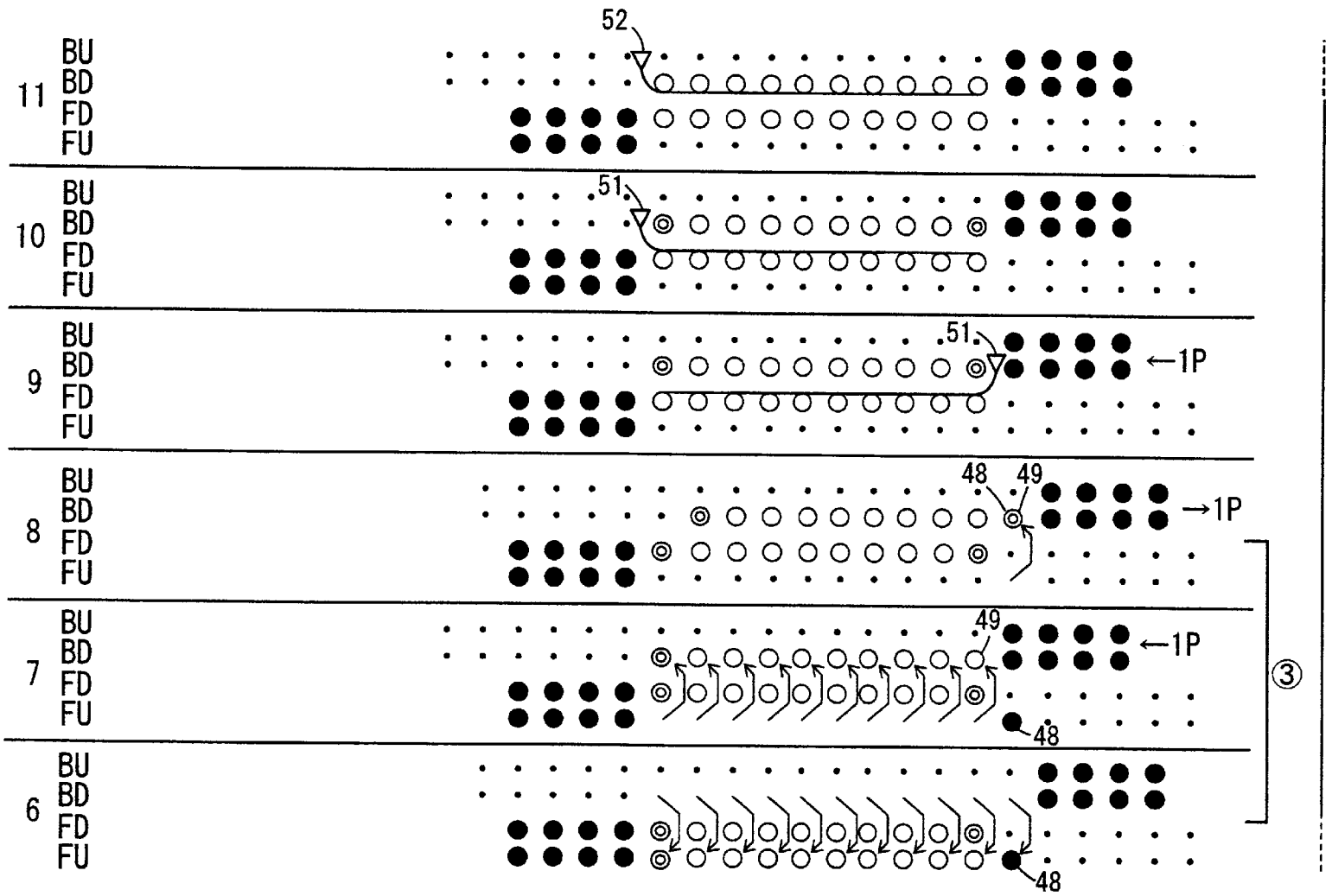
FIG. 10 illustrates knitting courses of the second embodiment.
Figure 11:
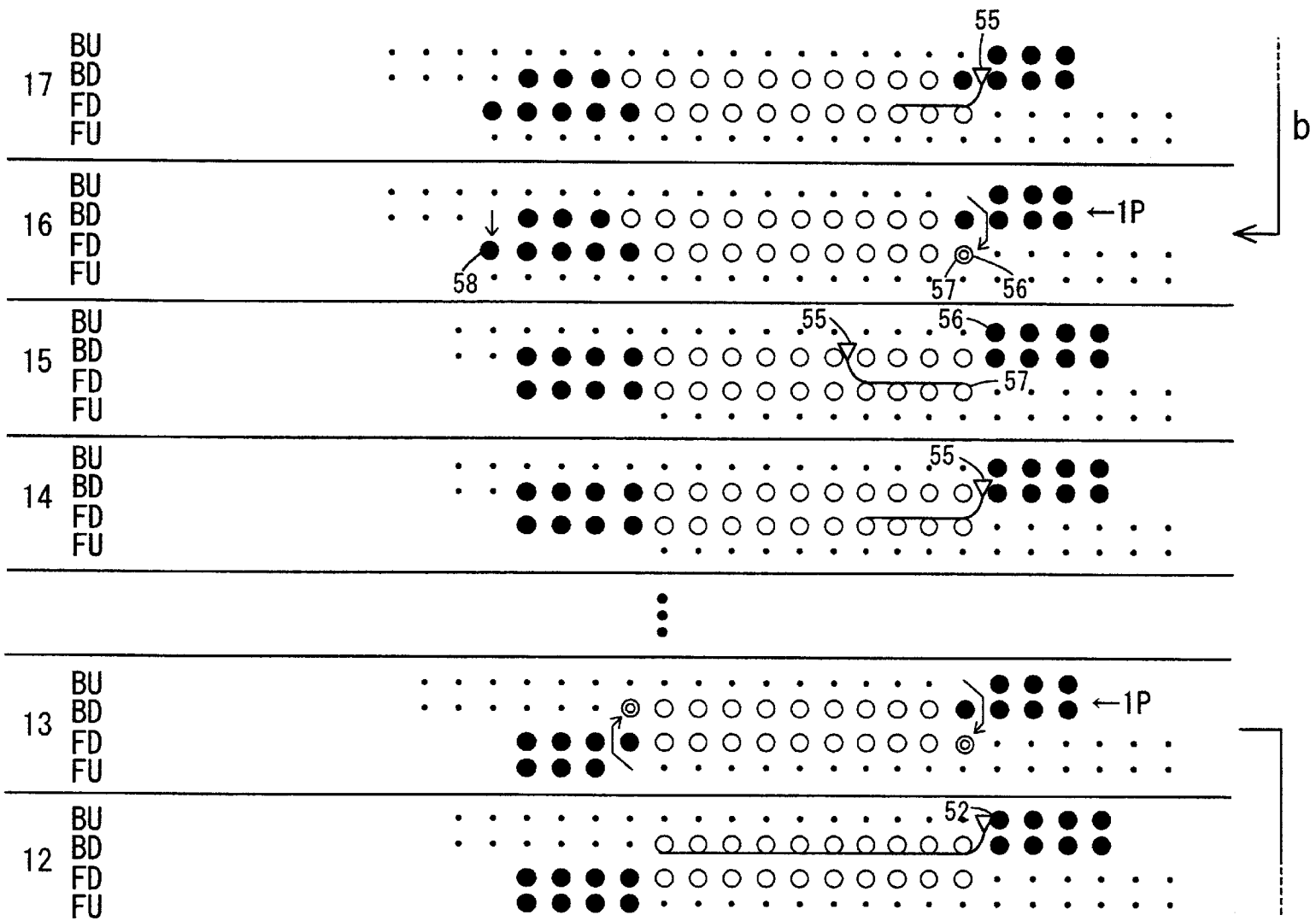
FIG. 11 illustrates knitting courses of the second embodiment.
Figure 12:
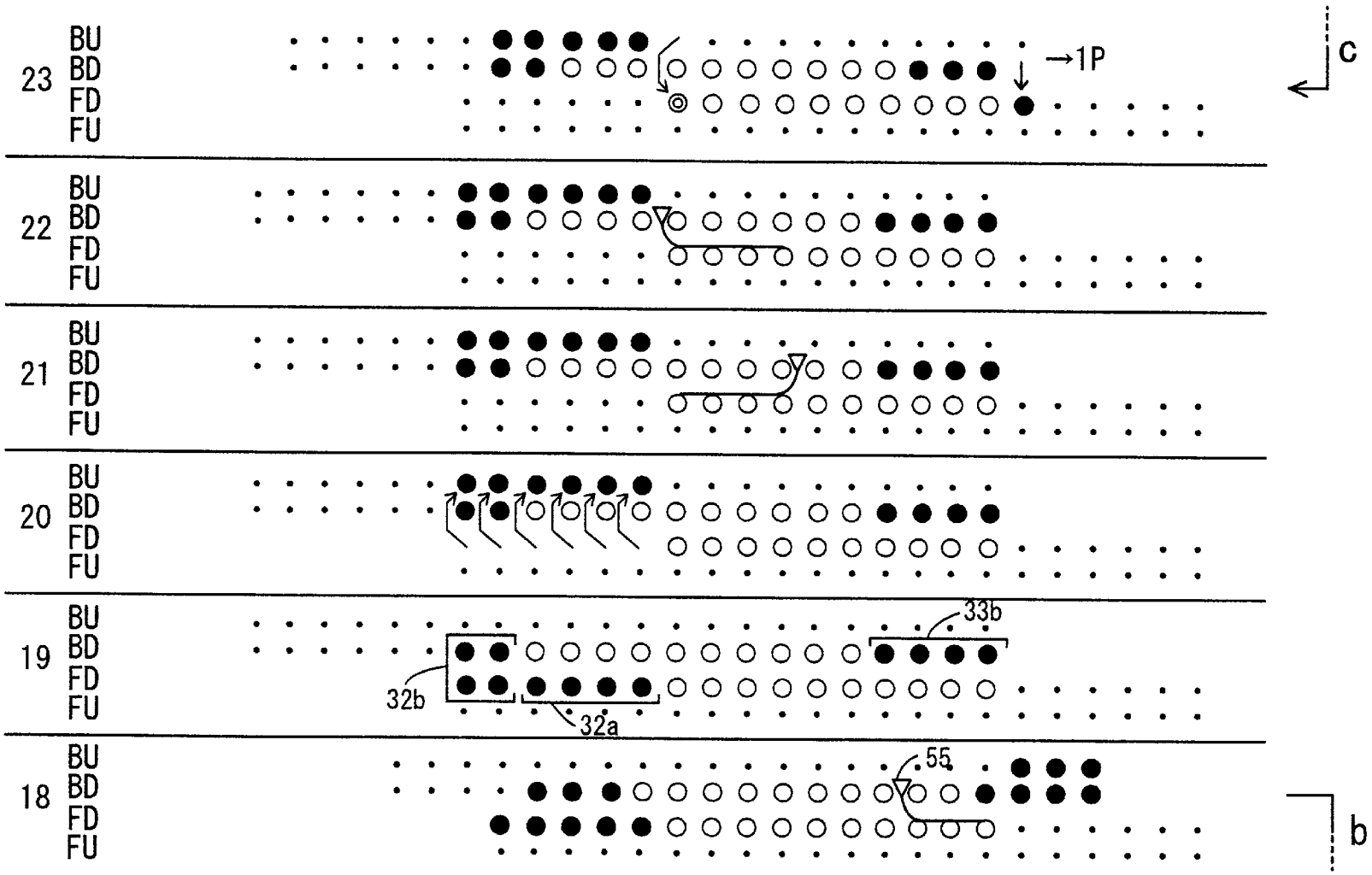
FIG. 12 illustrates knitting courses of the second embodiment.
Figure 13:
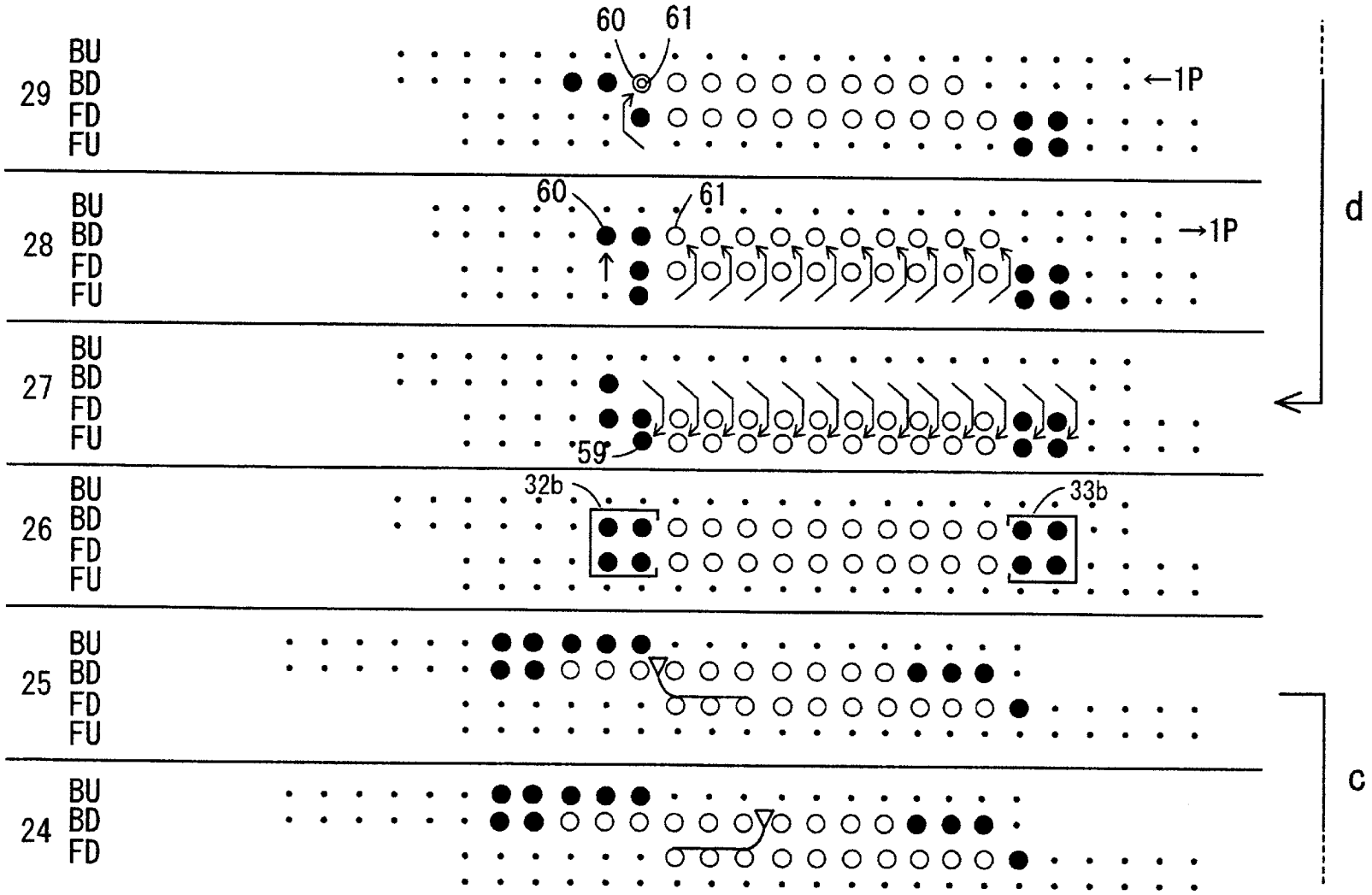
FIG. 13 illustrates knitting courses of the second embodiment.
Figure 14:
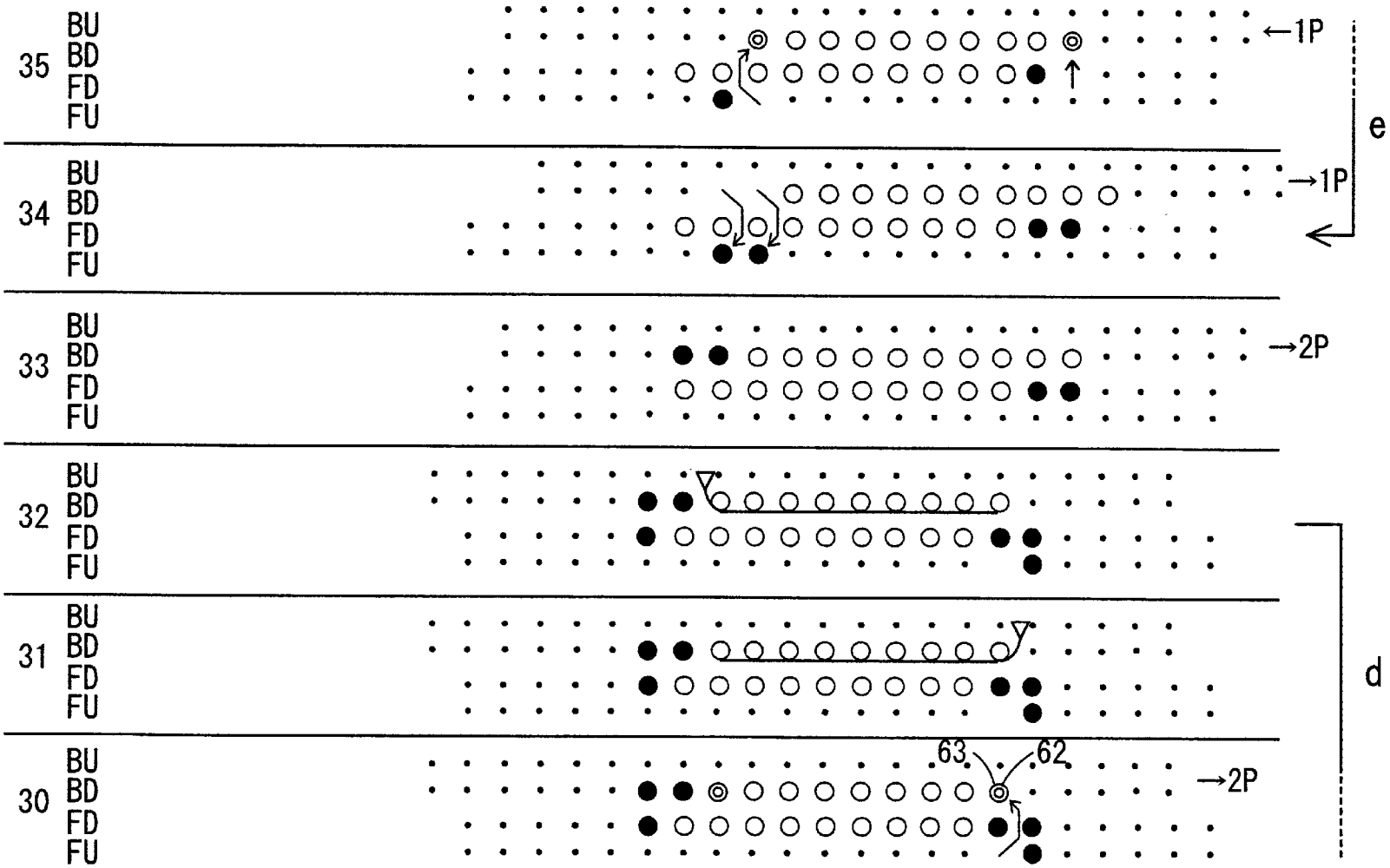
FIG. 14 illustrates knitting courses of the second embodiment.
Figure 15:
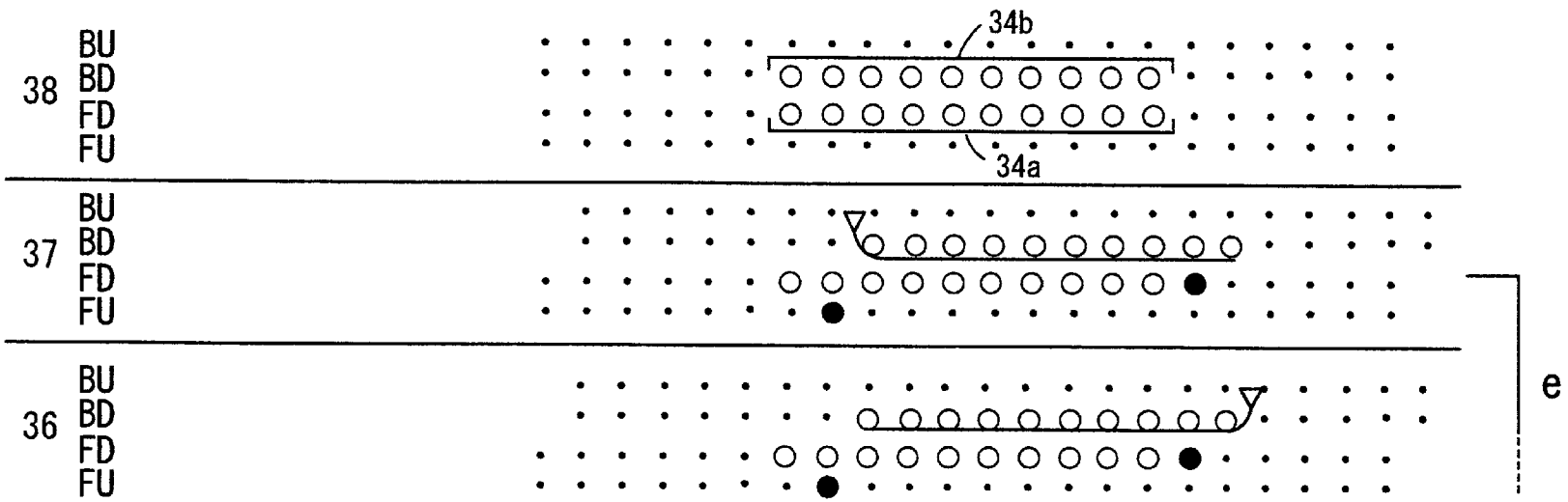
FIG. 15 illustrates knitting courses of the second embodiment.

In the following, description is made of the knitting for joining together the sleeves 32, 33 and the body 34 which are knitted up to where the process for joining them together is started. Referring to FIGS. 7–8, the outline of the knitted step Y where the neckline opening 41 is not formed and the knitting step X where the neckline opening 41 is formed will be described first. In FIGS. 7–8, the part where the next course loop is formed is depicted by a bold line and the part where the next course loop is not formed is depicted by a thin line. In the step Y of the second embodiment, the knitting wherein whenever after the front body 34*a* and the left front sleeve 33*a* are shifted toward the right front sleeve 32 by racking the needle bed, a loop at the right end of the front body 34*a* and a loop at the side end of the right front sleeve 32*a* are overlapped with each other and a loop at the side end of the left front sleeve 33*a* and a loop at the side end of the front body 34*a*are overlapped with each other, the yarn is fed to the front body 34*a* and the knitting wherein whenever after the back body 34*b* and the left back sleeve 33*b* are shifted toward the right back sleeve 32*b*, a loop at the left end of the back body 34*b* and a loop at the side end of the right back sleeve 32*b* are overlapped with each other and a loop at the side end of the left back sleeve 33*b* and a loop at the side end of the back body 34*b* are overlapped with each other, the yarn is fed to the back body 34*b* are performed in parallel. The state shown in FIG. 7-*a* is put into the state shown in FIG. 7-*b* by the knitting wherein the left front sleeve 33*a* is shifted toward the front body 34*a* to overlap the loops and the knitting (1) where the back body 34*b* and the left back sleeve 33*b* are shifted toward the right back sleeve 32*b* to overlap the loops. Sequentially, in FIG. 7-*b*, the knitting (2) wherein the left front sleeve 33*a* and the front body 34*a* are shifted toward the right front sleeve 32*a* to overlap the loop at the side end of the front body 34*a* and the loop at the side end of the right front sleeve 32*a* with each other is performed to produce the state of FIG. 7-*c* wherein the front knitted fabric is smaller in width than the back knitted fabric by one stitch. Sequentially, in FIG. 7-*c*, the knitting (3) wherein the left back sleeve 33*b* is shifted toward the back body 34*b* to overlap the loop at the side end of the back body 34*b* and the loop at the side end of the left back sleeve 33*b* with each other is performed to produce the state of FIG. 7-*d*. Subsequently, the knitting between FIG. 7-*a* and FIG. 7-*d* is repeated, whereby the number of stitches of the front knitted fabric and the back knitted fabric are gradually reduced by two stitches for each fabric. As a result of this, the state of FIG. 7-*e* is produced. In the step Y, while the right sleeve 32 is held on the same needles on the front needle bed and the left sleeve 33 is held on the same needles of the back needle bed, the body 34 in which the next course loop is formed even after the start of knitting for joining is transferred between the front and back needle beds so as to be joined to the sleeves 32, 33.

In the step X, after the left front body 42*b* is knitted, the left front body 42*b* and the left front sleeve 33*a* are joined together, as is illustrated from FIG. 8-*a* to FIG. 8-*b*. In parallel with the joining of the left front body 42*b* and the left front sleeve 33*a*, a circle knitting is performed, that is, a loop of at the side end of the right back sleeve 32*b* is transferred to outside of the right front sleeve 32*a*, to minimize the difference between the number of loops retained by the needles on the front needle bed and the number of loops retained by the needles on the back needle bed. Sequentially, in FIG. 8-*c*, while the right front body 42*a* is knitted, the right front body 42*a* and the right front sleeve 32*a* are joined together. In parallel with the joining of the right front body 42*a* and the light front sleeve 32*a*, the circle knitting is performed, whereby a loop of at the side end of the left back sleeve 33*b* is transferred to the front needle bed. As a result of the knitting mentioned above, the joining of the left and right front sleeves 32*a*, 33*a* and the left and right front bodies 42*a*, 42*b* is completed and the loops of the left and right back sleeves 32*b*, 33*b* are separately retained between the front and back needle beds by the circle knitting. In FIG. 8-*d*, the knitting wherein whenever after the back body 34*b* and the right back sleeve 32*b* are each shifted toward the left back sleeve 33*b*, a loop at the side end of the back body 34*b* and a loop at the side end of the right back sleeve 32*b* are overlapped with each other and a loop at the side end of the left back sleeve 33*b* and a loop at the side end of the back body 34*b* are overlapped with each other, the back body 34*b* is knitted and the circle knitting wherein a loop of at the side end of the right back sleeve 32*b* on the front needle bed is transferred to the back needle bed are performed in parallel. As a result of this, the back body 34*b* and the right back sleeve 32*b* are joined together and the back body 34*b* and the left back sleeve 33*b* are joined together, whereby the second knitted part of the second knitted fabric is retained on the back needle bed and the second knitted part of the third knitted fabric is retained on the front needle bed. In FIG. 8-*e*, the knitting wherein whenever after the back body 34*b* is shifted toward the right back sleeve 32*b*, the loop of the left back sleeve 33*b* is overlapped with the loop at the side end of the back body 34*b* and the loop of the right back sleeve 32*b* is overlapped with the loop at the side end of the back body 34*b*, the next course loop is formed in the back body 34*b* is repeated. As a result of this, the state of FIG. 8-*f* is produced, with which the knitting for joining is completed.

Referring now to the knitting courses of FIGS. 9–15, the knitting of the step X and the step Y will be described, beginning with the step Y. In the course 0 of FIG. 9, the right sleeve 32, the body 34 and the left sleeve 33 are retained in the order from the left as viewed in the figure. The right front sleeve 32*a* and the right back sleeve 32*b*; the front body 34*a* and the back body 34*b*; and the left front sleeve 32*a* and the right back sleeve 32*b* are each joined to each other at both ends thereof and formed into a tubular fabric. The left and right sleeves 32, 33 and the body 34 comprise a front knitted fabric part comprising the right front sleeve 32*a*, the front body 34*a*, and the left front sleeve 33*a*, and a back knitted fabric part comprising the right back sleeve 32*b*, the back body 32*b*, and the left back sleeve 33*b*. The front knitted fabric part is associated with the front lower needle bed FD and the back knitted fabric part is associated with the back lower needle bed BD, when knitted. In the courses 1–2 of FIG. 9, the knitting (1) of FIG. 7-*a* is performed. Accordingly, in the course 1, the left front sleeve 33*a* is transferred to the back upper needle bed BU and the right back sleeve 32*b* is transferred to the front upper needle bed FU. In the course 2, after the back needle bed is racked leftwards one pitch, a loop 41 at the left end of the left front sleeve 33*a* retained on the back upper needle bed BU is transferred to the front lower needle bed FD to overlap the loop 41 with a loop 42 at the right end of the front body 34*a* and simultaneously a loop 43 at the right end of the right back sleeve 32*b* retained on the front upper needle bed FU is transferred to the back lower needle bed BD to overlap the loop 43 with a loop 44 at the left end of the back body 34*b*.

In the courses 3–5, the knitting (2) is performed. In the course 3, the front body 34*a* including a double loop formed by overlapping with the loop 41 of the left front sleeve 33*a* and a loop 45 at the right end of the right front sleeve 32*a* are transferred to the back upper needle bed BU. In the course 4, after the back needle bed is racked leftwards one pitch, the loops of the front, body 34*a* are transferred to the front lower needle bed FD. In the course 5, after the back needle bed is racked rightwards one pitch, a loop 46 at the right end of the right front sleeve 32*a* is overlapped with a loop 47 at the right end of the front body 34*a*. In the course 6 for the knitting (3), the front body 34*a* including a double loop formed by overlapping with the loop of the right back sleeve 32*b* and a loop 48 at the left end of the left back sleeve 33*b* are transferred to the front upper needle bed FU. In the course 7, after the back needle bed is racked leftwards one pitch, the loops of the back body 34*b* are transferred to the back lower needle bed BD. In the course 8, after the back needle bed is racked rightwards one pitch, the loop 48 at the left end of the left back sleeve 33*b* is transferred to the back lower needle bed BD and overlapped with a loop 49 at the left end of the back body 34*b*. After this knitting manner, the loops in front and back parts of the right and left sleeves 32, 33 are, one loop for each, joined to the body 34. In the courses 9, 10, the yarn is fed to the front body 34*a* via a yarn feeder 51 and in the courses 11, 12, the yarn is fed to the back body 34*b* via a yarn feeder 52, whereby loops are formed on the double loops of the sleeves 32, 33 and the body 34. In the next course 13, the same knitting as that of the course 2 is performed. Thereafter, the knitting in the courses 3 to 13 are repeated and, as a result, the left sleeve 33 and the body 34 are shifted toward the right sleeve 32 and the sleeves 32, 33 and the body 34 are joined together.

Next, description will be made of the step X. In the courses 14 and 15 for starting the knitting for forming the neckline opening 41, a yarn feeder 55 is reversed to knit the left front body 42*a*. Sequentially, in the courses 16–18 for the knitting of FIG. 8-*b*, a loop 56 at the side end of the left front sleeve 33*a* retained on the back upper needle bed is overlapped with a loop 57 at the side end of the left front body 42*b* retained on the front needle bed. In parallel with this, the circle knitting is performed, that is, a loop 58 at the side end of the right back sleeve 32*b* is transferred to outside of the right front sleeve 32*a* on the front needle bed. In the courses 17–18, the left front body 42*a* is knitted. The knitting of the subsequent courses 16–18 are repeated until the joining of all loops of the left front sleeve 33*a* and the left front body 42*b* is completed. As a result of this, the state of the course 19 is produced. In the course 19, the joining of the left front sleeve 33*a* to the left front body 42*b* is completed and half of the loops of the right back sleeve 32*b* are retained on the front lower needle bed FD by the circle knitting. In the course 20, the loops of the right back sleeve 32*b* retained on the front lower needle bed FD are transferred to the back upper needle bed BU. Then, in the courses 21–25, the same knitting as the knitting for joining together the left front body 42*b* and the left front sleeve 33*a* is performed. In the courses 23–25, the knitting of FIG. 8-*c* is performed to produce the state of the course 26. In the course 26, the joining of the right front sleeve 32*a* to the right front body 42*a* is completed and half of the loops of the left and right back sleeves 32*b* , 33*b*are retained on the front needle bed FD by the circle knitting.

In the courses 27–32, the knitting of FIG. 8-*d* for joining of the back body 34*b* and the left and right sleeves 32*b*, 33*b* is performed. In the course 27, the loops of the back body 34*b* and the left back sleeve 33*b*and a loop 59 at the side end of the right back sleeve 32*b* are transferred to the front upper needle bed FU, before the back body 34*b* and the left back sleeve 33*b* are shifted toward the right back sleeve 32*b*. It should be noted that the loop 59 at the side end of the right back sleeve 32*b* is transferred to the front needle bed in this course, for the purpose of the sleeves 32, 33 at the right and left sides being overlapped with the back body 34*b* in the same order, though the knitting of this embodiment need not necessarily the same overlapping order. In the course 28, after the back needle bed is racked rightwards one pitch, the back body 34*b* is transferred back to the back lower needle bed BD and a loop 60 at the left end of the right back sleeve 32*b* on the front lower needle bed is transferred to and retained on the back lower needle bed BD by the circle knitting. In the course 29, after the back needle bed is racked leftwards one pitch, the loop 60 at the left end of the right back sleeve 32*b* as was transferred to the front upper needle bed FU is overlapped with a loop 61 at the side end of the back body 34*b* on the back needle bed. In the course 30, after the back needle bed is racked rightwards two pitches, a loop 62 at the side end of the left back sleeve 33*b* retained on the front needle bed is overlapped with a loop 63 at the side end of the back body 34*b*. Then, in the courses 31 and 32, the back body 34*b* is knitted. Subsequently, the knitting of the courses 27–32 is repeated, so that the left and right back sleeve parts 32*b*, 33*b* are sequentially joined to the back body 34*b* from the side closer to the back body 34*b* until the state of the course 33 is produced. In the course 33, the loops of the right back sleeve 32*b* are transferred back to the back lower needle bed BD by the circle knitting. In the courses 34–37, the knitting of FIG. 8-*e* is performed. In the course 34, the loop of the right back sleeve 32*b* is racked rightwards one pitch. In the course 35, after the back needle bed is racked leftwards one pitch, the loops of the right back sleeve 32*b* and left back sleeve 33*b* are transferred to the front upper needle bed FU and the loops of the same at a side thereof closer to the back body 34 are overlapped with the loops at the side ends of the back body 34*b*. Sequentially, in the courses 36 and 37, the yarn is fed to the back body. Subsequently, the knitting of the courses 34–37 are repeated until all the loops are joined together. As a result of this, the state of the course 38 is produced, with which the joining is completed.

As mentioned above, according to the second embodiment, the right sleeve 32 is retained on the same needles during the joining process. The front body 34*a* and the back body 34*b* of the body 34 are both sequentially changed over the needles closer to the right sleeve 32 on the front needle bed or the back needle bed. The left sleeve 33 is shifted toward the right sleeve 32 by racking, with the loops of the left sleeve 33 retained on the same needles. Thus, according to this joining method of this embodiment, the sleeves 32, 33 and the body 34 are joined together via the knitting for shifting the body 34 and the left sleeve 33 toward the right sleeve 32 through the use of a phase lag resulting from the racking of the front and back needle beds and the knitting for changing over the front and back bodies 34*a*, 34*b* between the front and back needle beds to overlap the loops of the body 34 and the loops of the right sleeve 32 and the left sleeve 33 at their respective side ends. Accordingly, when the joining method of this embodiment is used for at least a part of the joining process, the number of times for the loops to be transferred between the front and back needle beds for making the sleeves 32, 33 and the body 34 close to each other is reduced. As a result of the number of times for the transference of the sleeves being reduced, possible yarn breakage or loop elongation is suppressed. This can allow the sleeves 32, 33 and the body 34 to be joined together at an angle as large as right angles at which an orientation of the wale of the sleeves and an orientation of the wale of the body are crossed each other, and as such can allow the sleeve joining angle Z to be freely set by adjusting the proportion between the knitting for joining without knitting the sleeves 32, 33 and the knitting for joining while the sleeves 32, 33 are being knitted.

Third Embodiment

Figure 16:
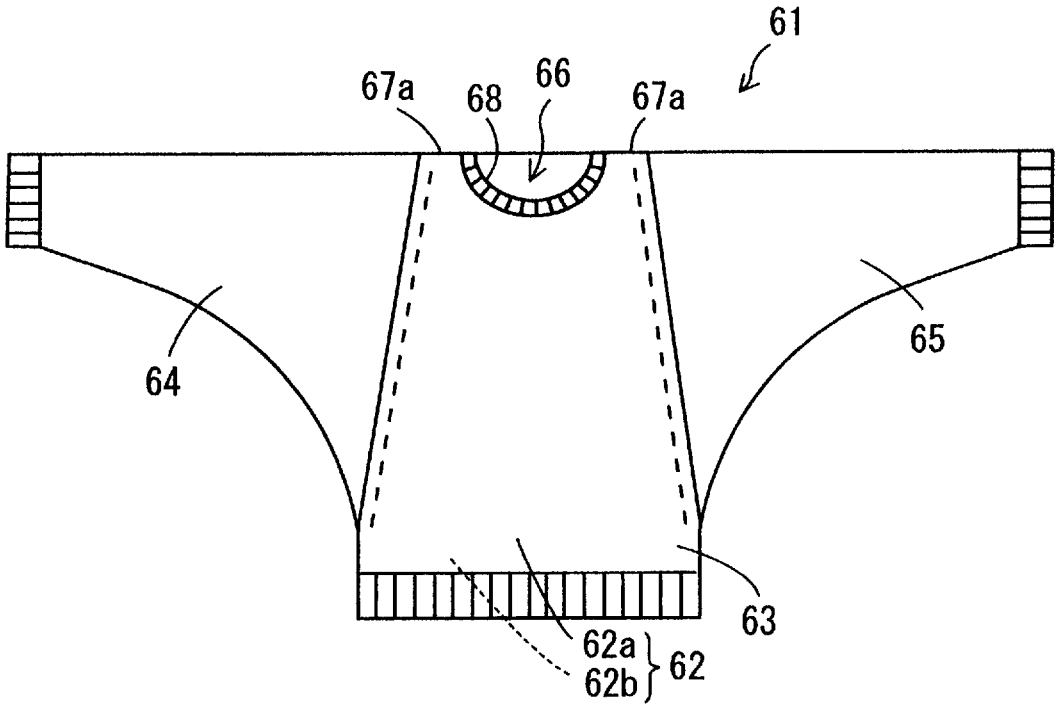
FIG. 16 shows a dolman sweater knitted in the third embodiment.
Figure 17:
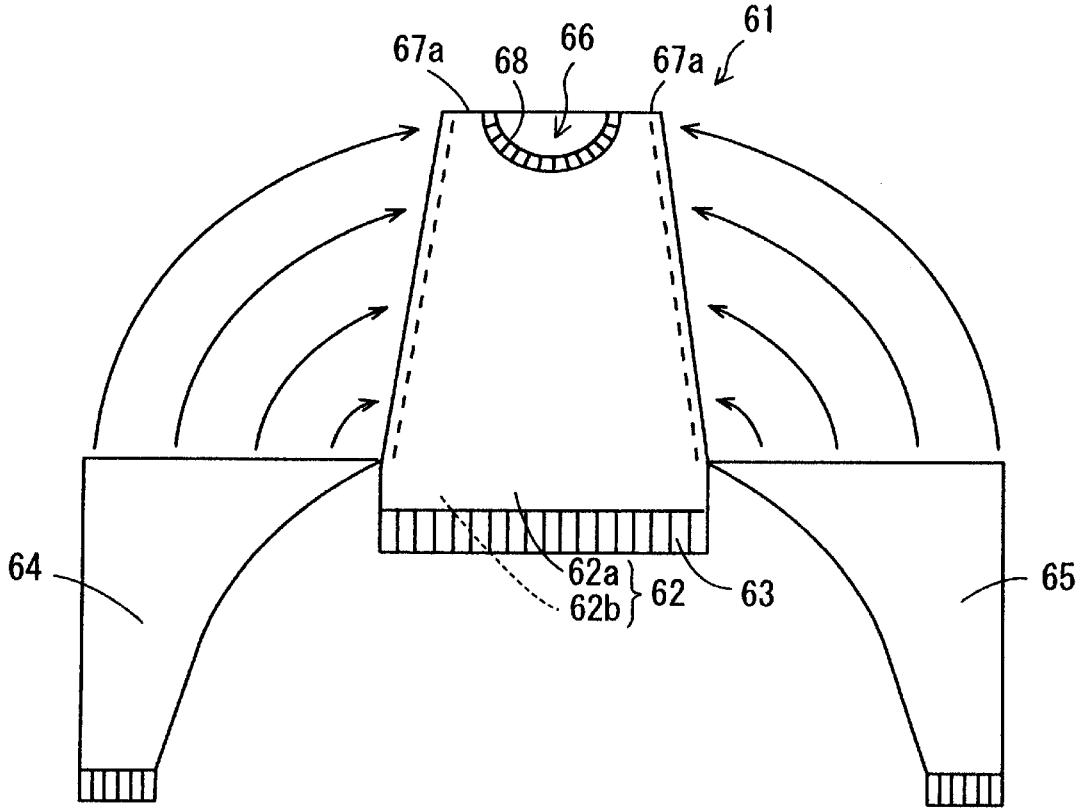
FIG. 17 illustrates a third embodiment.

Next, the third embodiment will be described with reference to FIGS. 16–17. The third embodiment is an embodiment of the method for knitting a dolman sweater 61 of FIG. 16. The dolman sweater 61 comprises a body 62 comprising a front body 62*a* and a back body 62*b* which are overlapped with each other and left and right sleeves 64, 65 which are each knitted in a tubular form. In this embodiment, the sleeves 64, 65 which increase in width increasingly toward joining regions and the body 62 are joined together from a position near to the rib-hem 63, in the process of which the knitting for narrowing the body 62 is performed to gradually decrease the knitting width of the body 62. The knitting for narrowing the body 62 may be performed either by using the outside narrowing wherein an outermost loop of the body 62 and a loop located inside of that loop are overlapped or by using the inside narrowing wherein the loops in the wale located inside at a proper distance from the side end of the body are overlapped with each other. The dolman sweater 61 is knitted in such a manner that a neckline opening 66 is formed in the process of knitting the body 62 and after completion of the joining of the sleeves 64, 65 and the body 62, the front body 62*a* and the back body 62*b* are joined together at the shoulders 67*a*, 67*b* and then a collar 68 is formed along the neckline opening 66. In general, when a sweater of a specific design having a wide joining region over which the sleeves and body are joined together, like the dolman sweater, is knitted, an increased number of times for the loop to be transferred between the front and back needle beds is needed for making the knitted fabrics close to each other. Due to this, yarn breakage, loop elongation and the like problem are easily generated. Accordingly, the general dolman sweater has the sleeves which are knitted in a different knitting direction from a direction in which sleeves of a general sweater are knitted from the cuffs toward the joining regions of the sleeves and the body. In contrast to this, the knitting method of this embodiment enables the sleeves to be knitted from the cuffs toward the joining regions of the sleeves and the body, thus affording the knitting of the sweater of a good design. As mentioned above, the third embodiment can also eliminate the need to transfer a loop between the front and back needle beds for making the knitted fabrics close to each other or can reduce the number of times for the loop to be transferred therebetween, as is the case with the second embodiment. While in the third embodiment, the sleeves and the body are joined together without knitting the sleeves during the joining of the sleeves and the body, a proper number of courses of the sleeves may be knitted during the joining of the sleeves and the body. When the proper number of courses of the sleeves is knitted in the course of the joining of the sleeves and the body, there can be provided the advantage that the sleeve attaching angle can be freely set. Also, while the knitting for narrowing is provided for the body in this embodiment, the knitting for narrowing is not necessarily needed.

Fourth Embodiment

Figure 18:
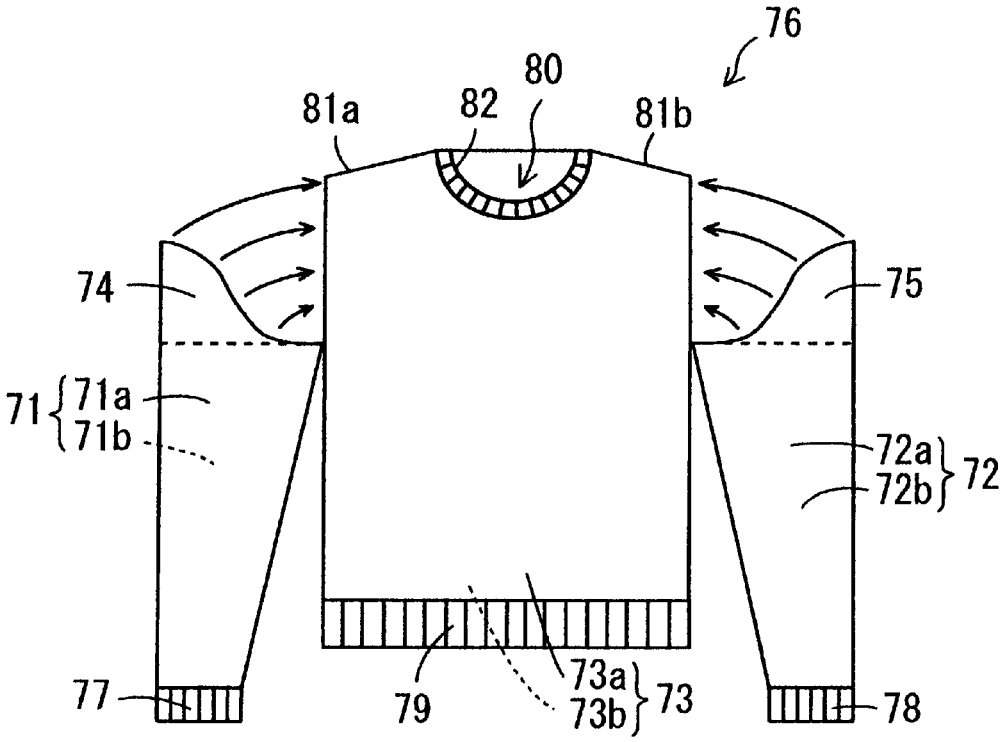
FIG. 18 illustrates a fourth embodiment.
Figure 19:
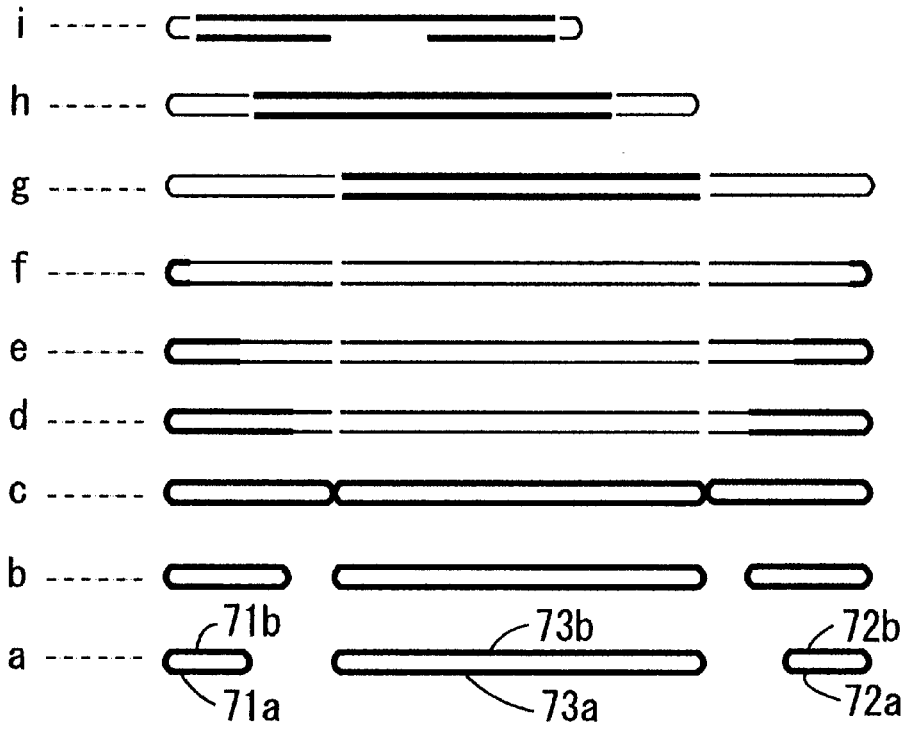
FIG. 19 illustrates the steps of a fourth embodiment.
Figure 20:
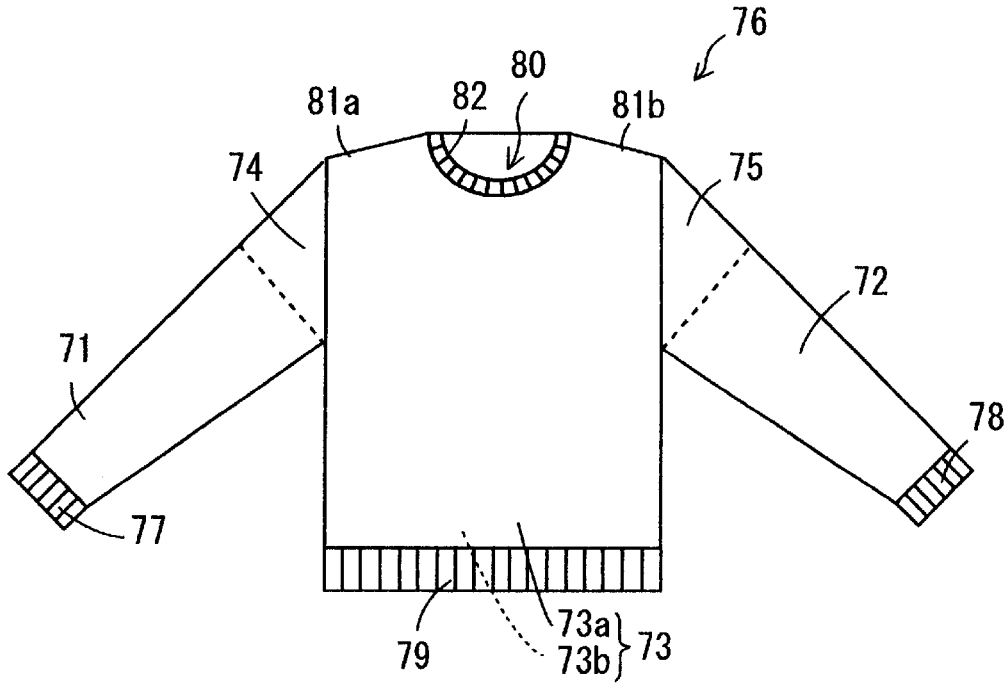
FIG. 20 shows a sweater knitted in the method of the fourth embodiment.

Next, the fourth embodiment will be described with reference to FIGS. 18–20. The fourth embodiment is an example of an application of the knitting method of the present invention to the knitting method of Japanese Laid-open (Unexamined) Patent Publication No. 2000-256947 as previously cited. This embodiment can eliminate the need of the special yarn which is required in the invention of Japanese Laid-open (Unexamined) Patent Publication No. 2000-256947. FIG. 19 illustrates the knitting steps of the fourth embodiment. In FIG. 19, the part where the next course loop is formed is depicted by a bold line and the part where the next course loop is not formed is depicted by a thin line. In the fourth embodiment, sleeves 71, 72 are knitted up from cuffs 77, 78 and a body 73 is knitted up from a rib hem 79. In the steps a–c of FIG. 19, the sleeves and the body are each knitted in the form of a tubular body until the knitting for joining together the body 73 and the sleeves 71, 72 is started, as is the case with the first embodiment. In the steps d–f, a flechage knitting is performed, that is, a yarn is fed in a C-shape by moving a yarn feeder in reciprocation between the loops at the side ends of the front sleeve 71*a*, 72*a* on the body side retained on the front needle bed and the loops at the side ends of the back sleeves 71*b*, 72*b* retained on the back needle bed, with those loops as the turning points of the yarn feeder, whereby the left and right sleeves 71, 72 are knitted to form left and right sleeve caps 74, 75. After the completion of the forming of the sleeve caps 74, 75, the front body 73*a* and the left front sleeve 72*a* are shifted toward the right front sleeve 71*a* in the steps g–i, as is the case with the second embodiment and also the back body 73*b* is shifted toward the right back sleeve 71*b* and the left back sleeve 72*b* is shifted toward the back body 73*b* in the same manner, whereby the sleeves 71, 72 and the body 73 are overlapped with each other. In addition, the knitting for forming the next course loops in the body 73 with the yarn fed to the body 73 is repeated to join together the sleeves 71, 72 and the body 73, in the process of which the neckline opening 80 is formed. Then, the front body 73*a* and the back body 73*b* are joined together at the shoulders 81*a*, 81*b* and then a collar 82 is formed along the neckline opening 80. After this manner, the sweater 76 is completed. In the fourth embodiment, since the sleeve caps 74, 75 are formed separately from the knitting of the body 73, the shape of the sleeve caps 74, 75 can be freely set, without any need to consider a ratio between the number of knitting courses of the sleeve caps 74, 75 and that of the body 73, and also the body and the sleeves can be knitted by using different yarn feeders. Thus, the fourth embodiment can also provide a decreased number of times for the loop to be transferred between the front and back needle beds for changing over the sleeves 71, 72 therebetween when the sleeves 71, 72 and the body 73 are joined together.

Figure 21:
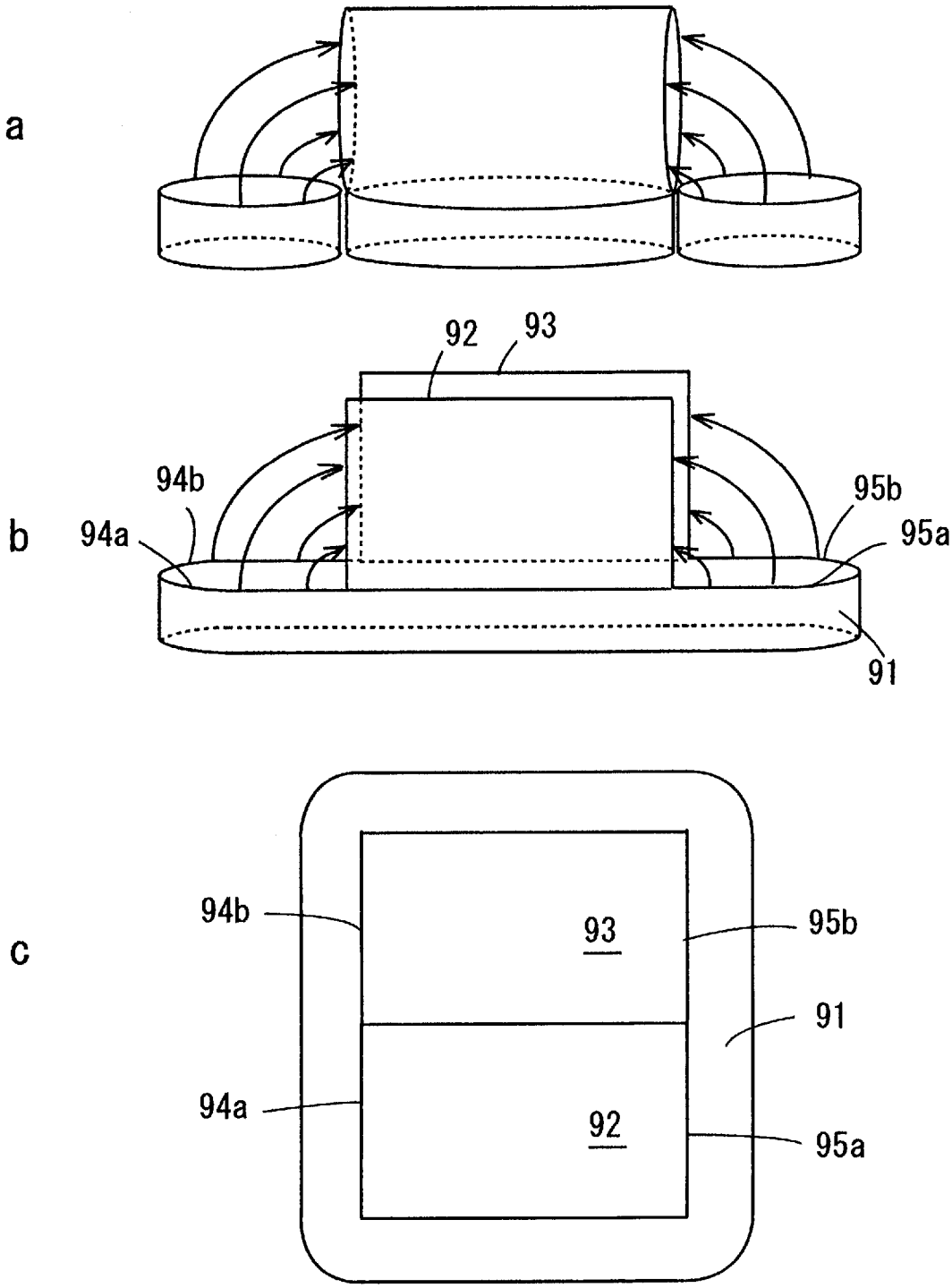
FIG. 21 illustrates a variant of the second embodiment.
Figure 22:
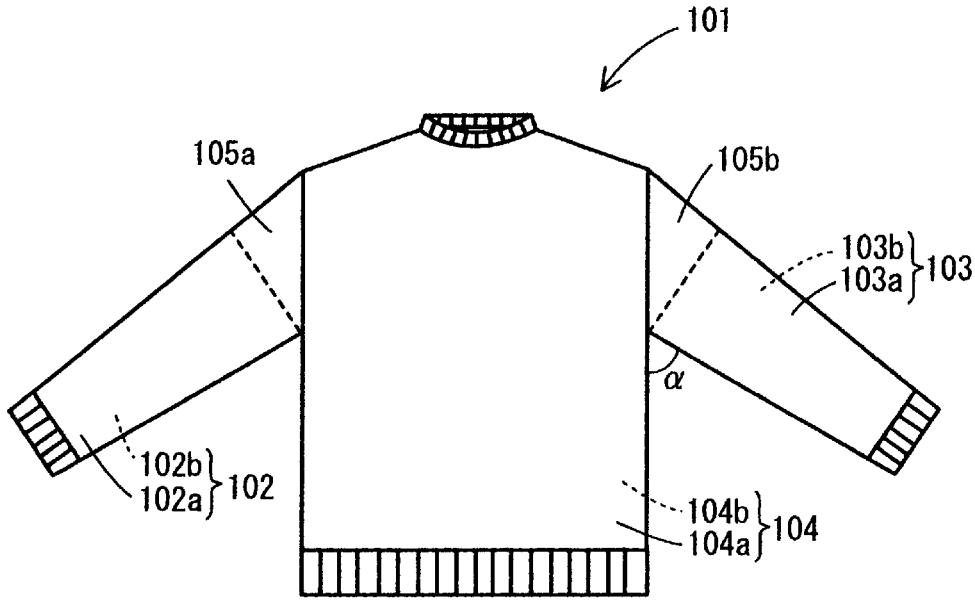
FIG. 22 shows a sweater whose sleeves and body are joined together in a conventional joining method.
Figure 23:
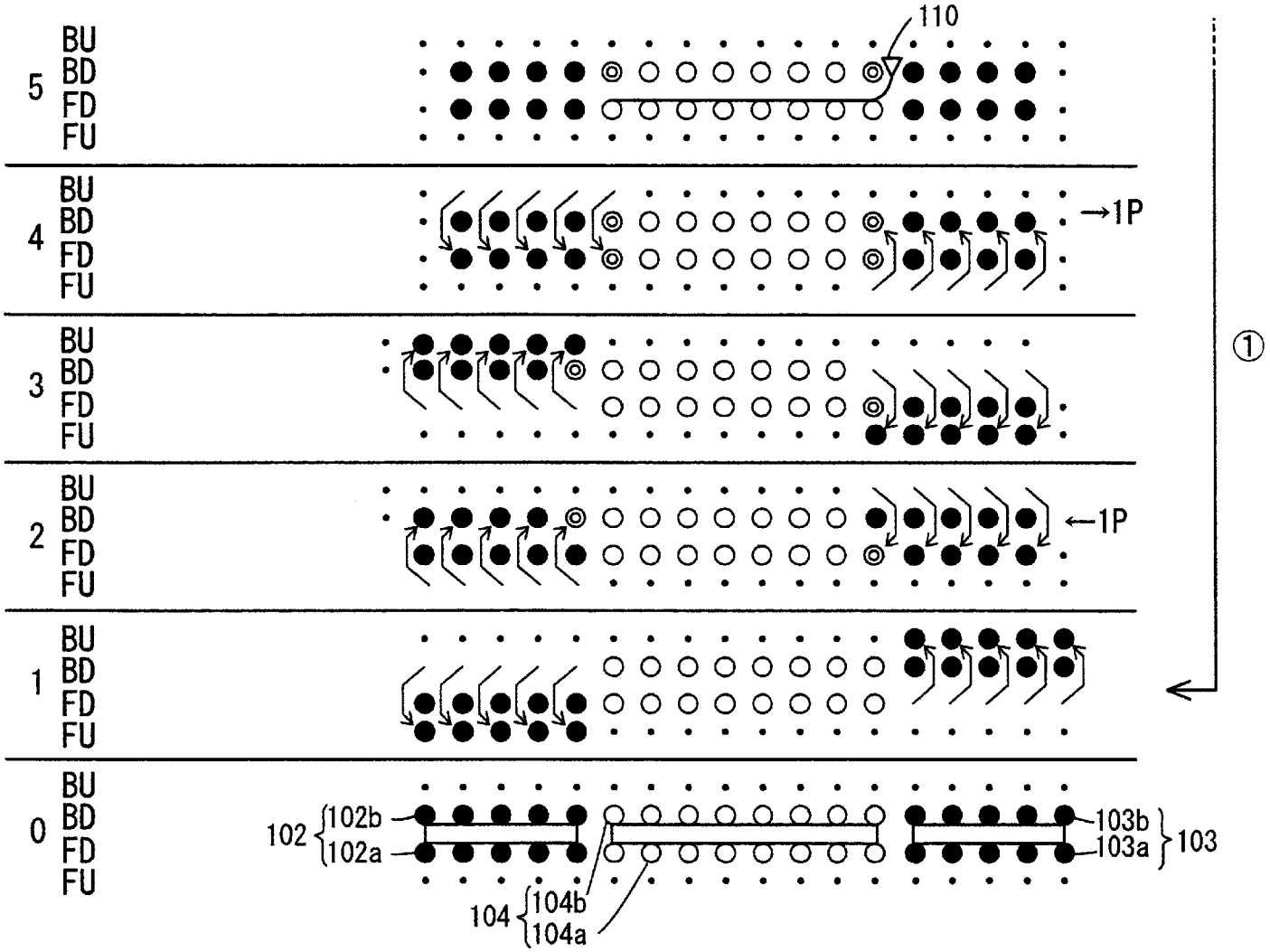
FIG. 23 illustrates knitting courses of the conventional joining method.
Figure 24:
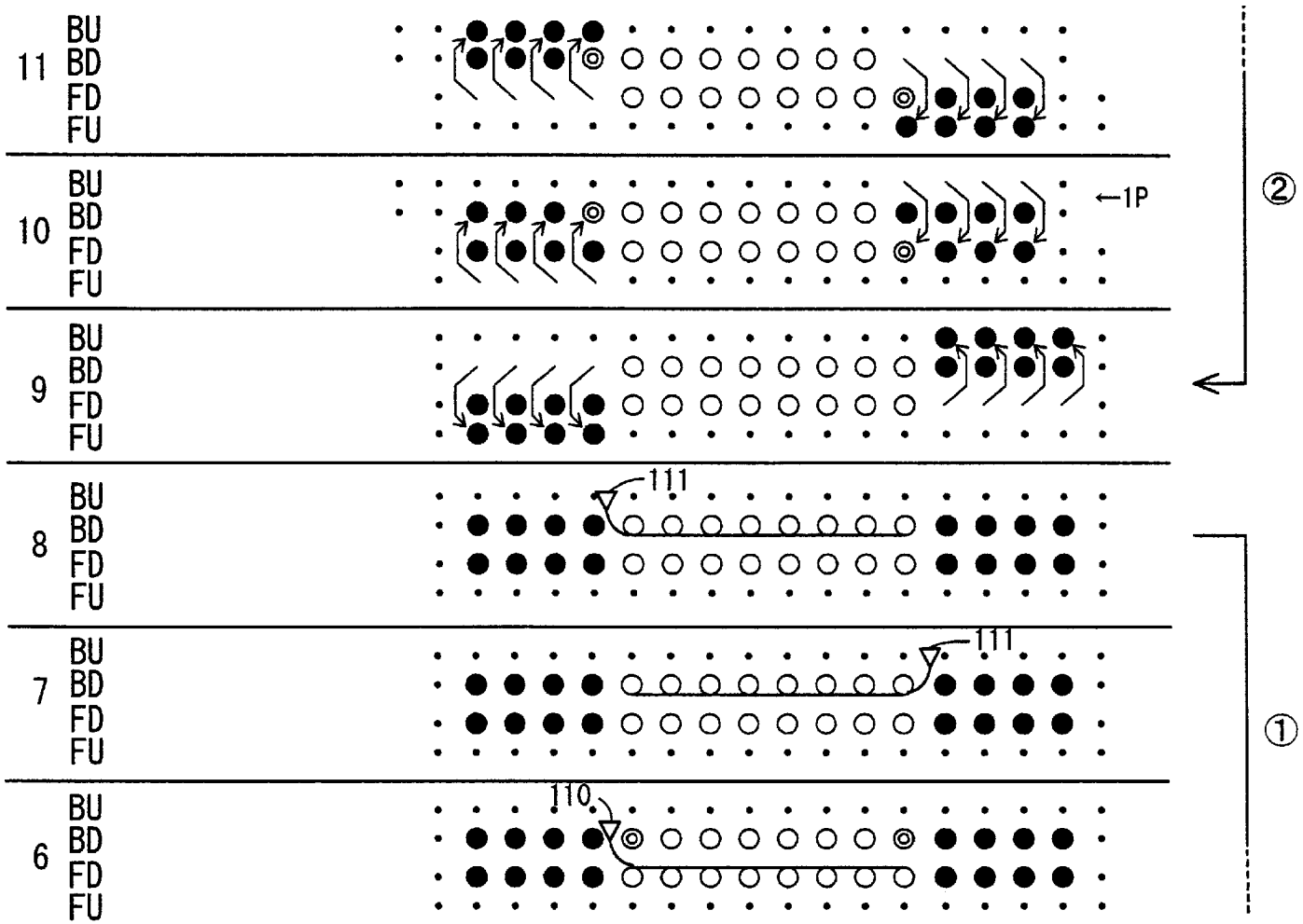
FIG. 24 illustrates knitting courses of the conventional joining method.
Figure 25:
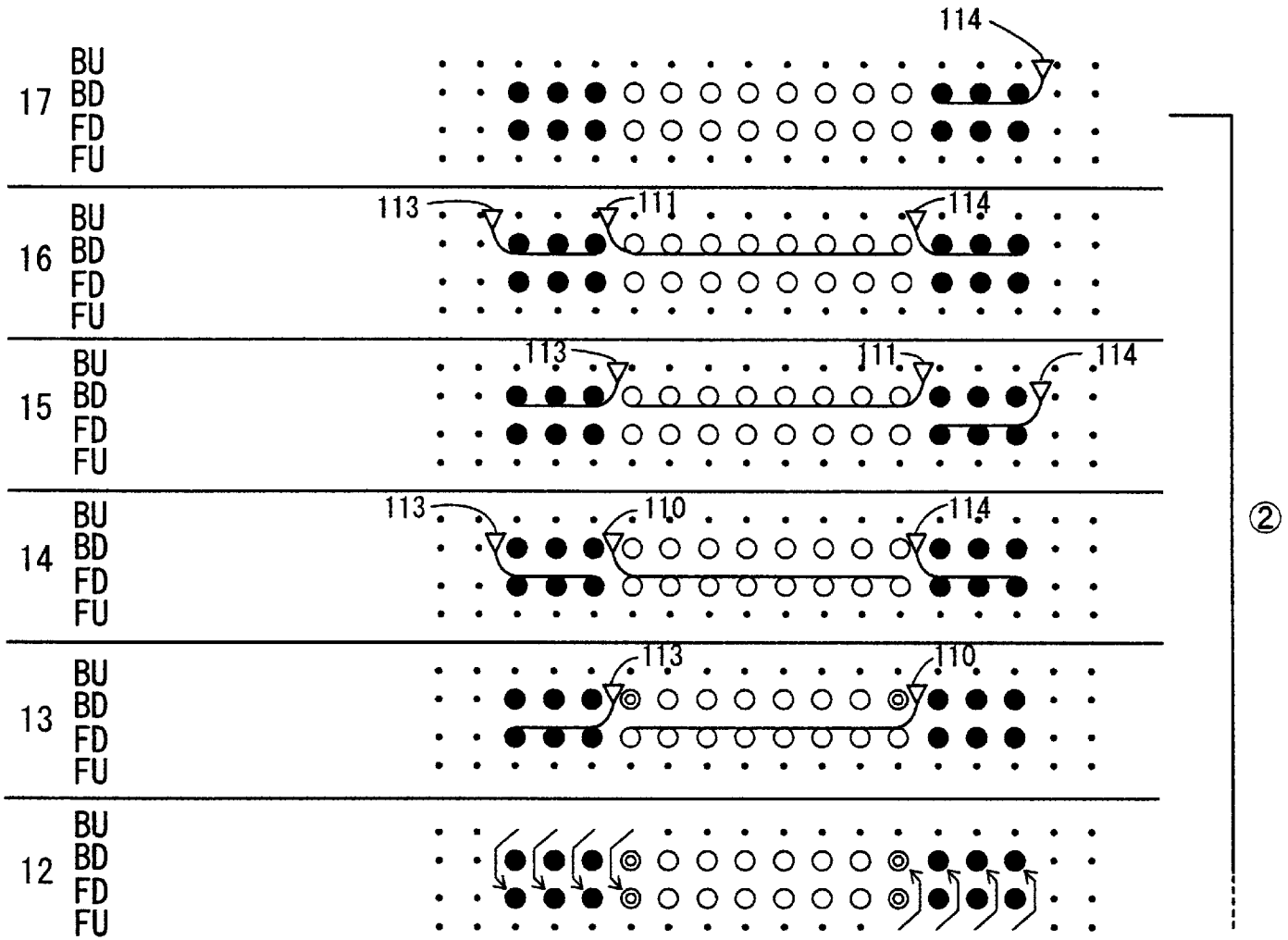
FIG. 25 illustrates knitting courses of the conventional joining method.

It should be noted that the joining method of the embodiments mentioned above need not necessarily be used from first to last for the joining process. For example, the conventional joining method may be used for the region where possible yarn brake or the like problem is not generated and the method of the present invention may be used for the remaining region. While in any of the embodiments described above, the body and the left sleeve are shifted toward the right sleeve, it is of course possible that the body and the right sleeve are shifted toward the left sleeve. Also, the knitting in which the body and the left sleeve are shifted toward the right sleeve and the knitting in which the body and the right sleeve may be shifted toward the left sleeve may be used in combination. Although the joining of the sleeves and the body of the sweater has been described in the embodiments above, the method of the present invention is applicable to the knitting of knitwear of other forms than the sweater, for example, to the knitting of a vest in which tubular rib fabrics are joined around the armholes or the knitting of a cardigan in which the first knitted fabric is knitted, with the front body parted right and left, rather than with the front body knitted into a completely tubular form. The embodiments above are merely shown as examples of carrying out the invention in practice and are not intended to put any limitation on the matters that could be easily modified or changed by persons skilled in the art having the ordinary knowledge, such as the knitting order and the handling of the yarn feeder. Although there has been illustrated in the second embodiment the case where the three separate tubular knitted fabrics are joined together, as shown in FIG. 21-*a*, the knitted fabrics to be joined together need not necessarily be separate knitted fabrics. For example, the knitted fabrics to be joined together may be a knitted fabric formed in the manner as shown in FIG. 21-*b*. In detail, a single tubular fabric 91 is knitted, first, and, then, a front knitted fabric 92 and a back knitted fabric 93 are knitted in a center region of the front knitted fabric. Thereafter, loops of the resting parts 94*a*, 94*b* and 95*a*, 95*b* at the left and right sides of the front and back knitted fabrics are joined to the loops at side ends of the front and back knitted fabrics 92, 93, whereby the resting parts 94*a*, 94*b* and 95*a*, 95*b* are joined to the both sides of the front and back knitted fabrics 92, 93. When the method of FIG. 21-*b* is used for joining the resting parts 94*a*, 94*b* and 95*a*, 95*b* to the both sides of the front and back knitted fabrics 92, 93 and then binding off the final courses of the front and back knitted fabrics 92, 93, the knitted fabric having set-up parts formed all around it as shown in FIG. 21-*c* can be formed. In the knitted fabric thus formed, as a result of the resting parts 94*a*, 94*b* and 95*a*, 95*b* being shifted to the both sides of the front and back knitted fabrics 92, 93, the front and back knitted fabrics comes to open at the both sides. For example, when the hem of a polo shirt is formed to be larger in width than the body; then the resting parts are joined along the body; and then the front and back bodies are knitted into a tubular form, a slit can be formed in the hem of the polo shirt.

Although there has been described in the embodiments above the case where the right sleeve is shifted toward the left sleeve, with the left sleeve retained on the front needle bed and the right sleeve retained on the back needle bed, the body and the left sleeve may be shifted toward the right sleeve and joined thereto. Further, the left sleeve and the right sleeve may be associated with the front and back needle beds, respectively, without any limitation on the needle beds to be associated with. Although there has been illustrated in the embodiments above the case where the outermost loops of the sleeves and the outermost loops of the body are overlapped with each other, the loops of the body to be joined to the loops of the sleeves need not necessarily be limited to the outermost loops. Further, although there has been illustrated in the embodiments above the case where the body is joined to the sleeves once each time two courses of the body are knitted, the body may be joined to the sleeves once each time one course of the body is knitted or three or four course of the body are knitted. The number of courses of the body to be knitted for each joining of the body to the sleeves can be freely set with out any limitation.

Capabilities of Exploitation in Industry

The method of the present invention can provide a decreased number of times for the loop to be transferred between the front and back needle beds, as compared with the conventional method according to which the knitted fabrics can be allowed to be close to each other so as to be joined together solely by changing over the knitted fabrics between the front and back needle beds by transferring loops therebetween. Thus, the present invention can suppress or minimize occurrence of yarn breakage, elongation of the loop to be joined and the like problem.

What is claimed is:

1. A knitted fabric joining method, using a flat knitting machine comprising at least a pair of first and second needle beds, which are extended laterally and confront each other in front and back; each of which has a large number of needles; and at least either of which can be racked laterally to transfer loops between the front and back needle beds, for knitting a first knitted fabric, a second knitted fabric and a third knitted fabric, with the first knitted fabric sandwiched between the second and third knitted fabrics, and joining the first knitted fabric to the second and third knitted fabrics in a joining process in which the knitting wherein loops in final courses of the second and third knitted fabrics are sequentially overlapped with loops at ends of the first knitted fabric from a side thereof closer to the first knitted fabric, processing from one end thereof toward the other end thereof, and next course loops are formed in the first knitted fabric is repeatedly performed, wherein with the second knitted fabric and the third knitted fabric separately retained on front and back needle beds, the first knitted fabric and the third knitted fabric are shifted toward the second knitted fabric by racking; then the first knitted fabric is changed over between the front and back needle beds and a loop of the first knitted fabric at an end thereof on the second knitted fabric side and a loop of the second knitted fabric at a side end thereof are overlapped with each other and a loop of the third knitted fabric at a side end thereof and a loop of the first knitted fabric at an end thereof on the third knitted fabric side are overlapped with each other; and then a yarn is fed to the first knitted fabric to form next course loops therein, this knitting process being repeatedly performed.

2. The knitted fabric joining method according to claim 1, wherein the first knitted fabric, the second knitted fabric, and the third knitted fabric each comprise a first knitted fabric part knitted in association with the first needle bed and a second knitted fabric part knitted in association with the second needle bed, the first knitted fabric part and the second knitted fabric part being knitted in an overlapping relation in front and back and formed into a tubular form, and wherein the knitting for shifting the first knitted fabric parts of the first and third knitted fabrics toward the first knitted fabric part of the second knitted fabric and the knitting for shifting the second knitted fabric parts of the first and third knitted fabrics toward the second knitted fabric part of the second knitted fabric are performed in parallel.

3. The knitted fabric joining method according to claim 2, wherein the joining process comprises the steps:

a) that the second knitted fabric part of the second knitted fabric is retained on the first needle bed and the first knitted fabric part of the third knitted fabric is retained on the second needle bed;

b) that with the second knitted fabric part of the second knitted fabric retained on the first needle bed and the first knitted fabric part of the third knitted fabric retained on the second needle bed, the first knitted fabric part of the third knitted fabric is shifted toward the first knitted fabric part of the first knitted fabric by racking, so that a loop of the first knitted fabric part of the third knitted fabric at a side end thereof and a loop of the first knitted fabric part of the first knitted fabric at a side end thereof are opposed to each other and are overlapped with each other, and the second knitted fabric part of the first knitted fabric is shifted toward the second knitted fabric part of the second knitted fabric, so that a loop of the second knitted fabric part of the first knitted fabric at an end thereof on the second knitted fabric side and a loop of the second knitted fabric part of the second knitted fabric at a side end thereof are opposed to each other and are overlapped with each other;

c) that in the course of the first knitted fabric part of the first knitted fabric being changed over between the front and back needle beds, the first knitted fabric part of the first knitted fabric is shifted toward the first knitted fabric part of the second knitted fabric, so that a loop of the first knitted fabric part of the first knitted fabric at an end thereof on the second knitted fabric side and a loop of the first knitted fabric part of the second knitted fabric at a side end thereof are opposed to each other and are overlapped with each other;

d) that in the course of the second knitted fabric part of the first knitted fabric being changed over between the front and back needle beds, the second knitted fabric part of the third knitted fabric is shifted toward the second knitted fabric part of the first knitted fabric, so that a loop of the first knitted fabric part of the third knitted fabric at a side end thereof and a loop of the second knitted fabric part of the first knitted fabric at an end thereof on the third knitted fabric side are opposed to each other and are overlapped with each other;

e) that yarns are fed to the first knitted fabric part and the second knitted fabric part of the first knitted fabric to form next course loops therein; and f) that the steps b to e are repeated.

4. The knitted fabric joining method according to claim 2, wherein a forked portion is formed in the first knitted fabric part of the first knitted fabric, and after the forked portion is started in form, the first knitted fabric part of the first knitted fabric is knitted in the form of a first "a" knitted fabric and a first "b" knitted fabric which confront each other across the forked portion, the joining method comprising the steps:

a) that the knitting wherein each time one of the needle beds is racked relative to the other, with the first knitted fabric part of the third knitted fabric retained on the second needle bed, so that a loop of the first knitted fabric part of the third knitted fabric at a side end thereof and a loop of the first "b" knitted fabric at a side end thereof are opposed to each other and are overlapped with each other, the yarn is fed to the first "b" knitted fabric to form the next course loops therein and the knitting where in a loop of the second knitted fabric part of the second knitted fabric is made to circle into the first needle bed are repeated;

b) that the knitting wherein each time the second needle bed is racked, with the first knitted fabric part of the second knitted fabric and the loop of the second knitted fabric part as was transferred to the first needle bed retained on the second needle bed, so that a loop of the first knitted fabric part of the second knitted fabric at a side end thereof and a loop of the first "a" knitted fabric at a side end thereof are opposed to each other and are overlapped with each other, the yarn is fed to the first "a" knitted fabric to form the next course loops therein and the knitting wherein a loop of the third knitted fabric is made to circle into the first needle bed are repeated;

c) that in the course of the second knitted fabric part of the first knitted fabric being changed over between the front and back needle beds, a loop of the second knitted fabric part of the first knitted fabric at a side end thereof and a loop of the second knitted fabric part of the third knitted fabric at a side end thereof are opposed to each other and are overlapped with each other; and each time a loop of the second knitted fabric part of the second knitted fabric at a side end thereof and a loop of the second knitted fabric part of the first knitted fabric at an end thereof on the second knitted fabric side are opposed to each other and are overlapped with each other, the yarn is fed to the second knitted fabric part of the first knitted fabric to form next course loops therein and also a loop of the second knitted fabric part of the second knitted fabric on the first needle bed is made to circle into the second needle bed; and d) that in the course of the second knitted fabric part of the first knitted fabric being changed over between the front and back needle beds, a loop of the second knitted fabric part of the first knitted fabric at an end thereof on the second knitted fabric side and a loop of the second knitted fabric part of the second knitted fabric at a side end thereof are opposed to each other and are overlapped with each other; and each time a loop of the second knitted fabric part of the third knitted fabric at a side end thereof and a loop of the second knitted fabric part of the first knitted fabric at a side end thereof are opposed to each other and are overlapped with each other, the yarn is fed to the second knitted fabric part of the first knitted fabric to form next course loops therein.

5. The knitted fabric joining method according to claim 2, wherein the first knitted fabric is a knitted fabric knitted in the form of a body and the second and third knitted fabrics are knitted fabrics knitted in the form of right and left sleeves, and wherein after sleeve caps of the right and left sleeves are formed in a flechage knitting, the sleeves and the body are joined together.

6. The knitted fabric joining method according to claim 2, wherein the first knitted fabric, the second knitted fabric, and the third knitted fabric are knitted in the form of a first region, a second region, and a third region of an entire knitted fabric formed in the form of a single tubular fabric.

7. A knitted fabric knitted by using a flat knitting machine comprising at least a pair of first and second needle beds, which are extended laterally and confront each other in front and back; each of which has a large number of needles; and at least either of which can be racked laterally to transfer loops between the front and back needle beds, wherein a first knitted fabric, a second knitted fabric and a third knitted fabric are knitted, with the first knitted fabric sandwiched between the second and third knitted fabrics, and the first knitted fabric is joined to the second and third knitted fabrics in a joining process in which the knitting wherein loops in final courses of the second and third knitted fabrics are sequentially overlapped with loops at ends of the first knitted fabric from a side thereof closer to the first knitted fabric, processing from one end thereof toward the other end thereof, and next course loops are formed in the first knitted fabric is repeatedly performed, in the process of which with the second knitted fabric and the third knitted fabric separately retained on front and back needle beds, the first knitted fabric and the third knitted fabric are shifted toward the second knitted fabric by racking; the first knitted fabric is changed over between the front and back needle beds and a loop of the first knitted fabric at an end thereof on the second knitted fabric side and a loop of the second knitted fabric at a side end thereof are overlapped with each other and a loop of the third knitted fabric at a side end thereof and a loop of the first knitted fabric at an end thereof on the third knitted fabric side are overlapped with each other; and then a yarn is fed to the first knitted fabric to form next course loops therein, this knitting process being repeatedly performed to join together the first, second and third knitted fabrics.

* * * * *